US008959943B2

(12) United States Patent
Schukar et al.

(10) Patent No.: US 8,959,943 B2
(45) Date of Patent: Feb. 24, 2015

(54) ICE AGITATOR

(75) Inventors: Murray Schukar, Fitchburg, WI (US); Robin Nelson, Monroe, WI (US); Jeff Siedschlag, Edgerton, WI (US)

(73) Assignee: Sub-Zero, Inc., Madison, WI (US)

( * ) Notice: Subject to any disclaimer, the term of this patent is extended or adjusted under 35 U.S.C. 154(b) by 459 days.

(21) Appl. No.: 13/477,496

(22) Filed: May 22, 2012

(65) Prior Publication Data

US 2013/0312448 A1 Nov. 28, 2013

(51) Int. Cl.
*F25C 1/22* (2006.01)

(52) U.S. Cl.
USPC ..... 62/340; 62/344

(58) Field of Classification Search
USPC ..... 62/320, 340, 342, 344, 353; 222/226; 366/279
See application file for complete search history.

(56) References Cited

U.S. PATENT DOCUMENTS

| | | | | |
|---|---|---|---|---|
| 3,368,723 | A | 2/1968 | Hardeman | |
| 3,437,244 | A * | 4/1969 | Alvarez et al. | 222/240 |
| 3,887,119 | A | 6/1975 | Sucro et al. | |
| 3,902,331 | A * | 9/1975 | True, Jr. et al. | 62/137 |
| 3,968,906 | A | 7/1976 | Kochendorfer et al. | |
| 4,181,244 | A | 1/1980 | Karlovits | |
| 4,248,276 | A | 2/1981 | Gosnell | |
| 4,632,280 | A | 12/1986 | Mawby et al. | |
| 4,972,999 | A * | 11/1990 | Grace | 241/30 |
| 5,056,688 | A | 10/1991 | Goetz et al. | |
| 5,119,639 | A | 6/1992 | Bein et al. | |
| 5,211,462 | A | 5/1993 | Bien et al. | |
| 5,299,716 | A | 4/1994 | Hawkins et al. | |
| 5,910,164 | A | 6/1999 | Snelling et al. | |
| 6,089,030 | A | 7/2000 | Darden | |
| 6,685,053 | B2 | 2/2004 | Hawkes et al. | |
| 6,860,408 | B2 | 3/2005 | Hawkes | |
| 6,904,946 | B2 | 6/2005 | James | |
| 6,953,132 | B2 | 10/2005 | McCann et al. | |
| 7,065,975 | B1 | 6/2006 | Herndon et al. | |
| 7,104,291 | B2 | 9/2006 | Dalton et al. | |
| 7,770,409 | B2 | 8/2010 | Anderson | |
| 7,814,762 | B2 | 10/2010 | Kavchale et al. | |
| 8,011,202 | B2 | 9/2011 | Kim et al. | |
| 2010/0192612 | A1 | 8/2010 | White et al. | |
| 2012/0036881 | A1 | 2/2012 | Lawson et al. | |

* cited by examiner

*Primary Examiner* — Melvin Jones
(74) *Attorney, Agent, or Firm* — Bell & Manning, LLC

(57) ABSTRACT

An ice agitation system includes an adaptor and an ice agitator. The adaptor includes a disk portion and an auger mounting channel. The auger mounting channel is configured to mount to a shaft of an auger such that the adaptor rotates with the shaft of the auger. The auger mounting channel extends in a direction parallel to and offset from a center axis of a disk formed by the disk portion. The ice agitator includes a hook and an arm that extends from the hook away from the center axis of the disk. The hook is mounted to the disk.

20 Claims, 44 Drawing Sheets

ICE AGITATOR

BACKGROUND

An ice maker is a device that makes ice cubes and deposits the ice cubes into an ice receptacle from which the ice cubes can be dispensed to a recipient container for use by a consumer. The ice maker may be a stand-alone device or may be included in a freezer that includes a freezer space that may or may not be connected to a refrigerator that includes a refrigerated space. Ice dispensers are known to include an auger to move the ice out of the ice receptacle and into a chute for delivery on demand to the consumer. The ice in the ice receptacle, however, may stick together making it difficult to dispense ice cubes consistently or even preventing the dispensation of ice cubes altogether.

SUMMARY

In an example embodiment, an ice agitation system is provided. The ice agitation system may include an adaptor and an ice agitator. The adaptor includes a disk portion and an auger mounting channel. The auger mounting channel is configured to mount to a shaft of an auger such that the adaptor rotates with the shaft of the auger. The auger mounting channel extends in a direction parallel to and offset from a center axis of a disk formed by the disk portion. The ice agitator includes a hook and an arm that extends from the hook away from the center axis of the disk. The hook is mounted to the disk.

In another example embodiment, an ice dispenser is provided. The ice dispenser may include an ice receptacle, an auger, an actuator, an adaptor, and an ice agitator. The ice receptacle includes a plurality of walls and an ice dispensing aperture formed through a wall of the plurality of walls. The auger includes a spherical flight and a shaft extending from the spherical flight in a direction of an axis of rotation of the spherical flight. The auger is mounted between two walls of the plurality of walls and is configured to push ice toward the ice dispensing aperture based on the rotation of the spherical flight. The actuator is mounted to rotate the auger about the axis of rotation. The adaptor includes a disk portion and an auger mounting channel. The shaft of the auger is mounted within the auger mounting channel such that the adaptor rotates with the shaft of the auger. A center axis of a disk formed by the disk portion extends in a direction parallel to and offset from a center of the shaft of the auger. The ice agitator includes a hook and an arm that extends from the hook away from the shaft of the auger. The hook is mounted to the disk.

In another example embodiment, a device is provided. The device may include a body, a door, a hinge pivotally mounting the door to the body, an ice receptacle, an ice maker, an auger, an actuator, an adaptor, and an ice agitator. The body defines a freezer space. The ice receptacle includes a plurality of walls and an ice dispensing aperture formed through a wall of the plurality of walls. The ice maker is mounted within the body and is configured to discharge ice into the ice receptacle. The auger includes a spherical flight and a shaft extending from the spherical flight in a direction of an axis of rotation of the spherical flight. The auger is mounted between two walls of the plurality of walls and is configured to push ice toward the ice dispensing aperture based on the rotation of the spherical flight. The actuator is mounted to rotate the auger about the axis of rotation. The adaptor includes a disk portion and an auger mounting channel. The shaft of the auger is mounted within the auger mounting channel such that the adaptor rotates with the shaft of the auger. A center axis of a disk formed by the disk portion extends in a direction parallel to and offset from a center of the shaft of the auger. The ice agitator includes a hook and an arm that extends from the hook away from the shaft of the auger. The hook is mounted to the disk.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
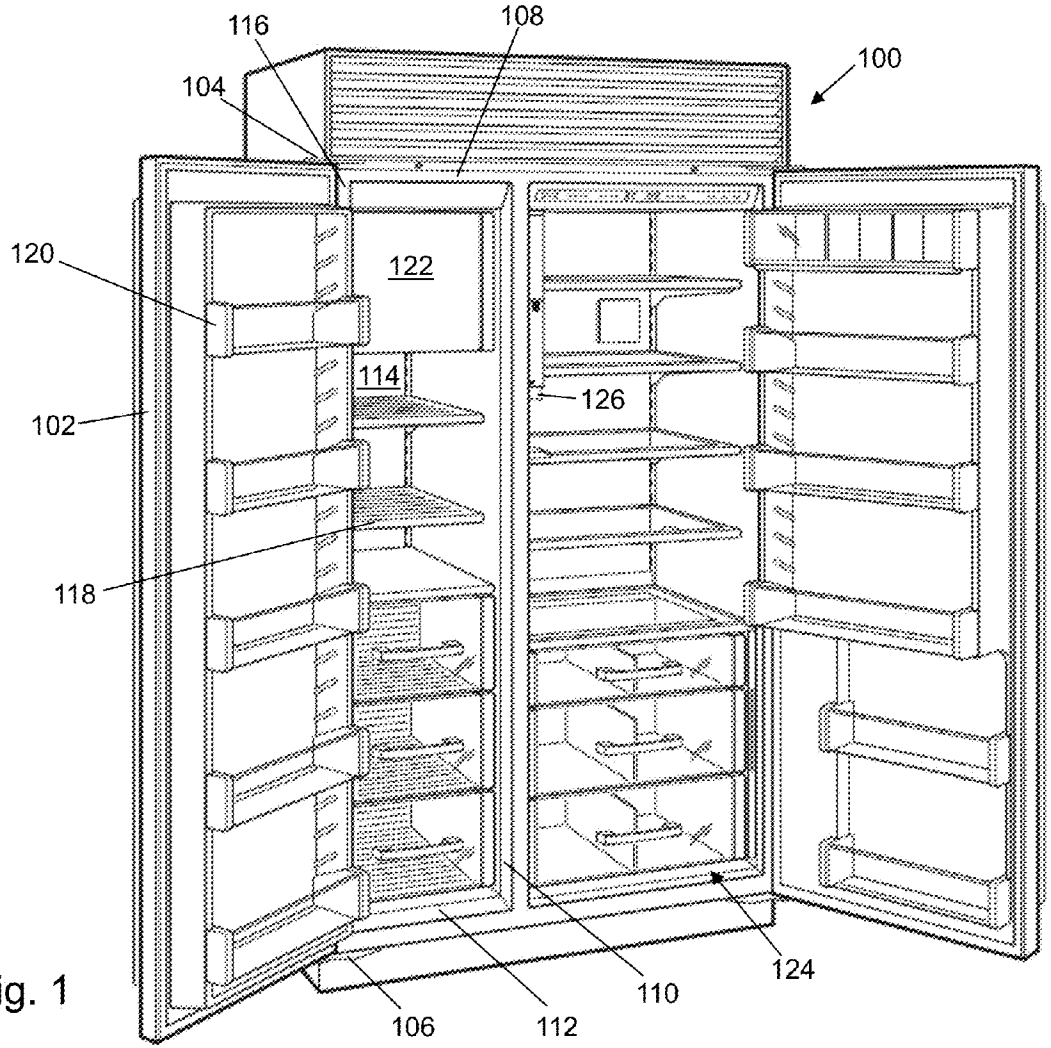
FIG. 1 depicts a freezer in accordance with an illustrative embodiment.

With reference to FIG. 1, a device 100 is shown in accordance with an illustrative embodiment. Device 100 may include a door 102, a first hinge 104, a second hinge 106, a top wall 108, a first side wall 110, a bottom wall 112, a back wall 114, and a second side wall 116. In the illustrative embodiment, door 102 is rotably mounted to top wall 108 and bottom wall 112 using first hinge 104 and second hinge 106, respectively. In alternative embodiments, door 102 may be rotably mounted to different walls of device 100 using a fewer or a greater number of hinges. Door 102 provides access to a freezer space defined by top wall 108, first side wall 110, bottom wall 112, back wall 114, second side wall 116, and door 102 when door 102 is in a closed position. Though shown in the illustrative embodiment as forming a generally rectangular shaped enclosure, device 100 may form any shaped enclosure including other polygons as well as circular or elliptical enclosures. As a result, door 102 and the walls forming device 100 may have any shape including other polygons as well as circular or elliptical shapes.

One or more shelves, drawers, or other receptacles may be mounted within the freezer space defined by the walls of device 100. For example, a shelf 118 is positioned to mount between first side wall 110 and second side wall 116. One or more shelves, drawers, or other receptacles may be mounted to an inside surface of door 102. For example, a door shelf 120 is configured to mount to the inside surface of door 102. An ice maker/dispenser 122 may be mounted within the freezer space. In an alternative embodiment, ice maker/dispenser 122 may be mounted to the inside surface of door 102 to dispense ice exterior to the freezer space as understood by a person of skill in the art. For example, ice maker/dispenser 122 may be positioned on door shelf 120 to dispense ice when door 102 is either in the opened or the closed positions. Ice maker/dispenser 122 further may be mounted directly to a wall of device 100. As understood by a person of skill in the art, the dispensing of ice by the ice dispenser may be controlled using a switch activated by a consumer. For illustration, the switch may be similar to that described in U.S. Pat. No. 7,814,762 titled INTEGRATED ICE DISPENSER SWITCH and issued Oct. 19, 2010.

As used in this disclosure, the term "mount" includes join, unite, connect, couple, associate, insert, hang, hold, affix, attach, fasten, bind, paste, secure, bolt, screw, rivet, solder, weld, glue, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be two discrete structural elements.

Device 100 may be a stand-alone device having various shapes and sizes. Device 100 further may be mounted or positioned adjacent to a refrigerated space that is either above, below, to the left, or to the right of device 100 without limitation. Use of directional terms, such as top, bottom, right, left, front, back, etc. are merely intended to facilitate reference to the various surfaces of the described structures relative to the orientations shown in the drawings and are not intended to be limiting in any manner. In the illustrative embodiment of FIG. 1, the freezer space defined by top wall 108, first side wall 110, bottom wall 112, back wall 114, second side wall 116, and door 102 is mounted to the left of a refrigerated space 124. First side wall 110 forms a wall that adjoins the freezer space and refrigerated space 124. In the illustrative embodiment of FIG. 1, an ice dispenser housing 126 of ice maker/dispenser 122 is positioned on first side wall 110 in refrigerated space 124 on a side of first side wall 110 and configured to dispense ice when requested by a consumer from ice made and stored by ice maker/dispenser 122.

Figure 2:
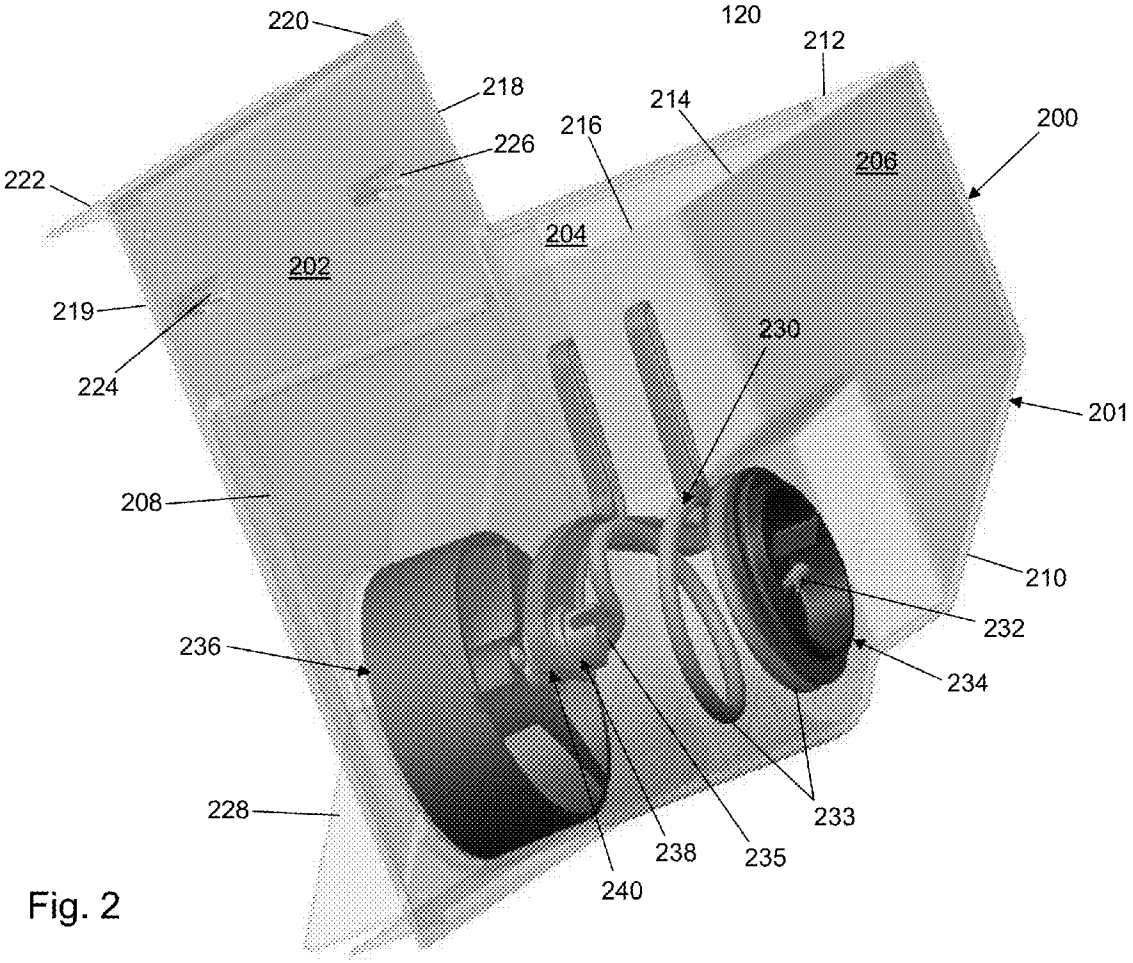
FIG. 2 depicts a right side, perspective view of an ice dispenser in accordance with an illustrative embodiment.
Figure 3:
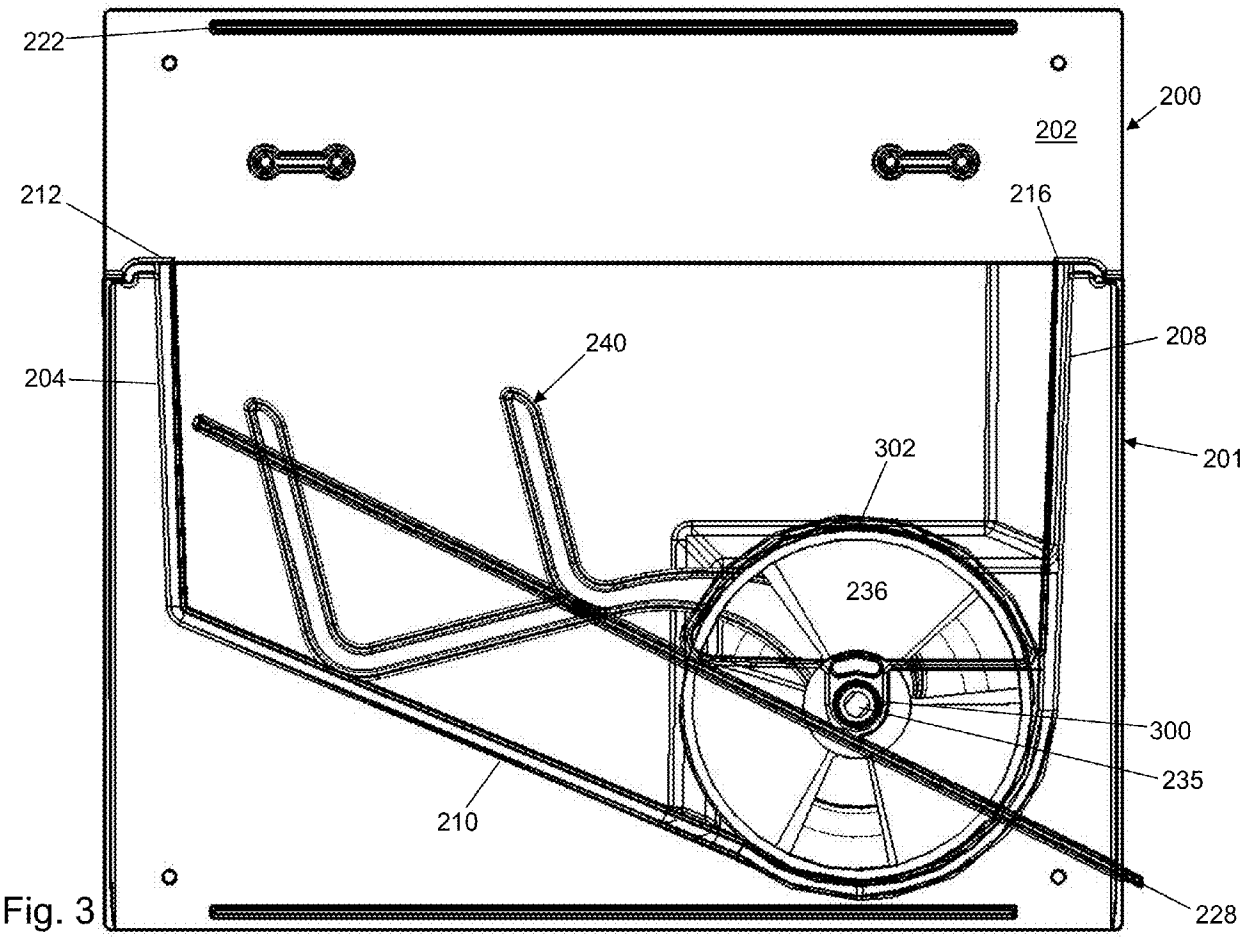
FIG. 3 depicts a front view of the ice dispenser of FIG. 2 in accordance with an illustrative embodiment.
Figure 4:
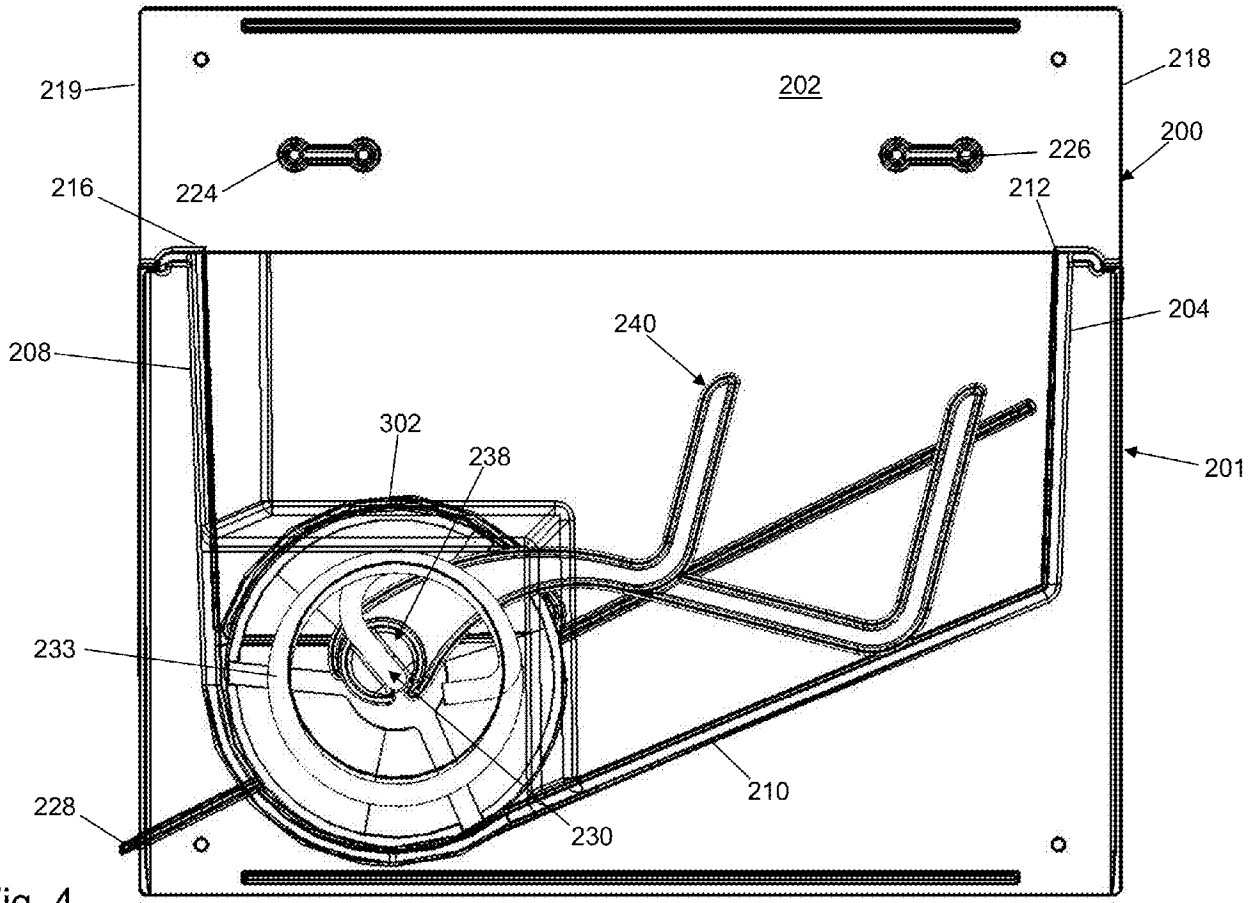
FIG. 4 depicts a back view of the ice dispenser of FIG. 2 in accordance with an illustrative embodiment.
Figure 5:
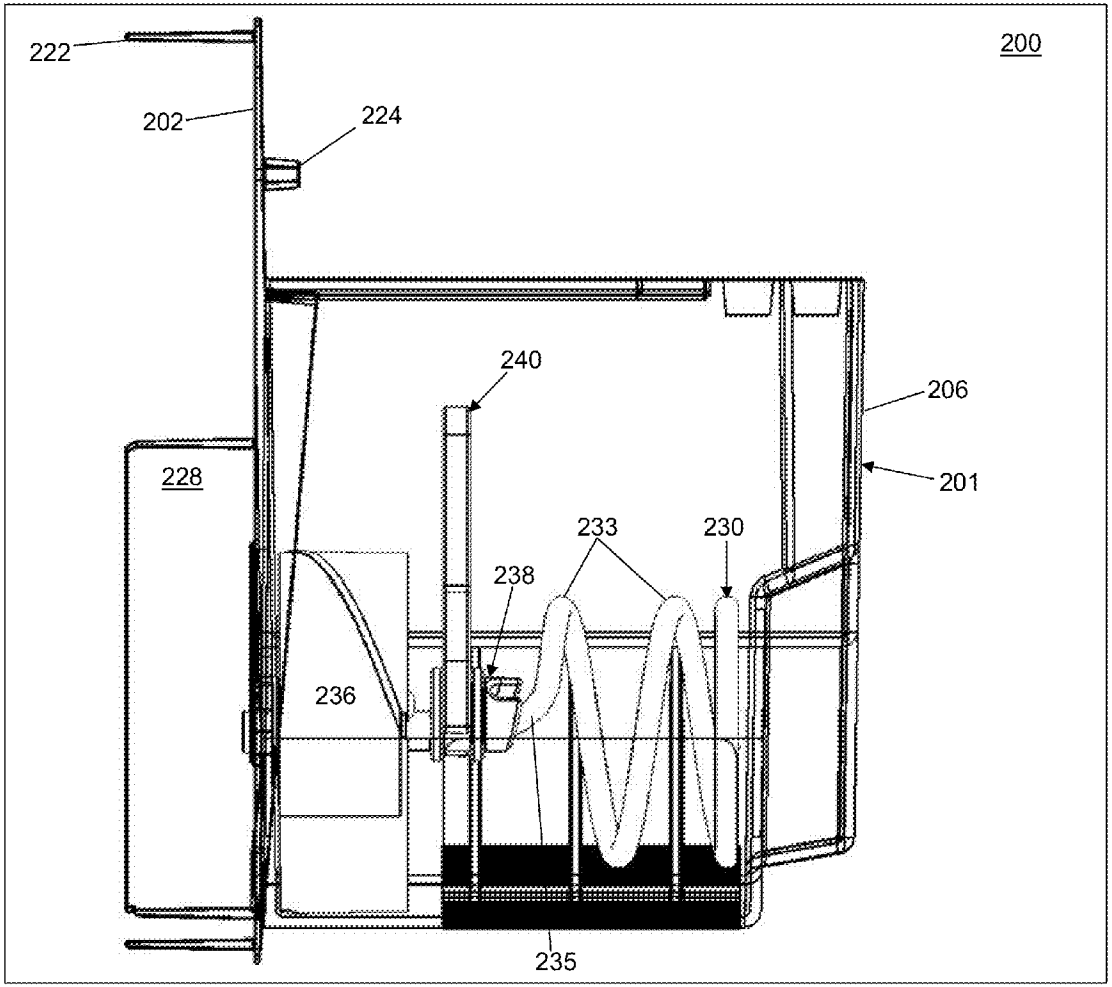
FIG. 5 depicts a right side view of the ice dispenser of FIG. 2 in accordance with an illustrative embodiment.

With reference to FIG. 2, a right, side, perspective view of an ice dispenser 200 of ice maker/dispenser 122 is shown in accordance with an illustrative embodiment. With reference to FIG. 3, a front view of ice dispenser 200 is shown in accordance with an illustrative embodiment. With reference to FIG. 4, a back view of ice dispenser 200 is shown in accordance with an illustrative embodiment. With reference to FIG. 5, a right side view of ice dispenser 200 is shown in accordance with an illustrative embodiment. The components of ice dispenser 200 described herein may be formed of one or more materials, such as metals and/or plastics, having a sufficient strength and rigidity based on the amount of material used to support the described application. Ice dispenser 200 includes an ice receptacle 201 into which ice from an ice maker (not shown) of ice maker/dispenser 122 is discharged. The ice maker may have a variety of forms as understood by a person of skill in the art. Ice pieces, or cubes, may be formed by the ice maker and delivered to ice receptacle 201 as understood by a person of skill in the art. The term ice cube is not intended to be indicative of the shape of the ice piece as the ice piece may be formed to have a variety of shapes including spheres, cylinders, multi-sided polygons, etc. all of which may be referenced generally as an ice cube. The size of the ice cube is further not intended to be limiting though in general the ice cubes are sized for consumer use in drinks and to keep products cold and are generally larger than ice shavings.

Figure 6:
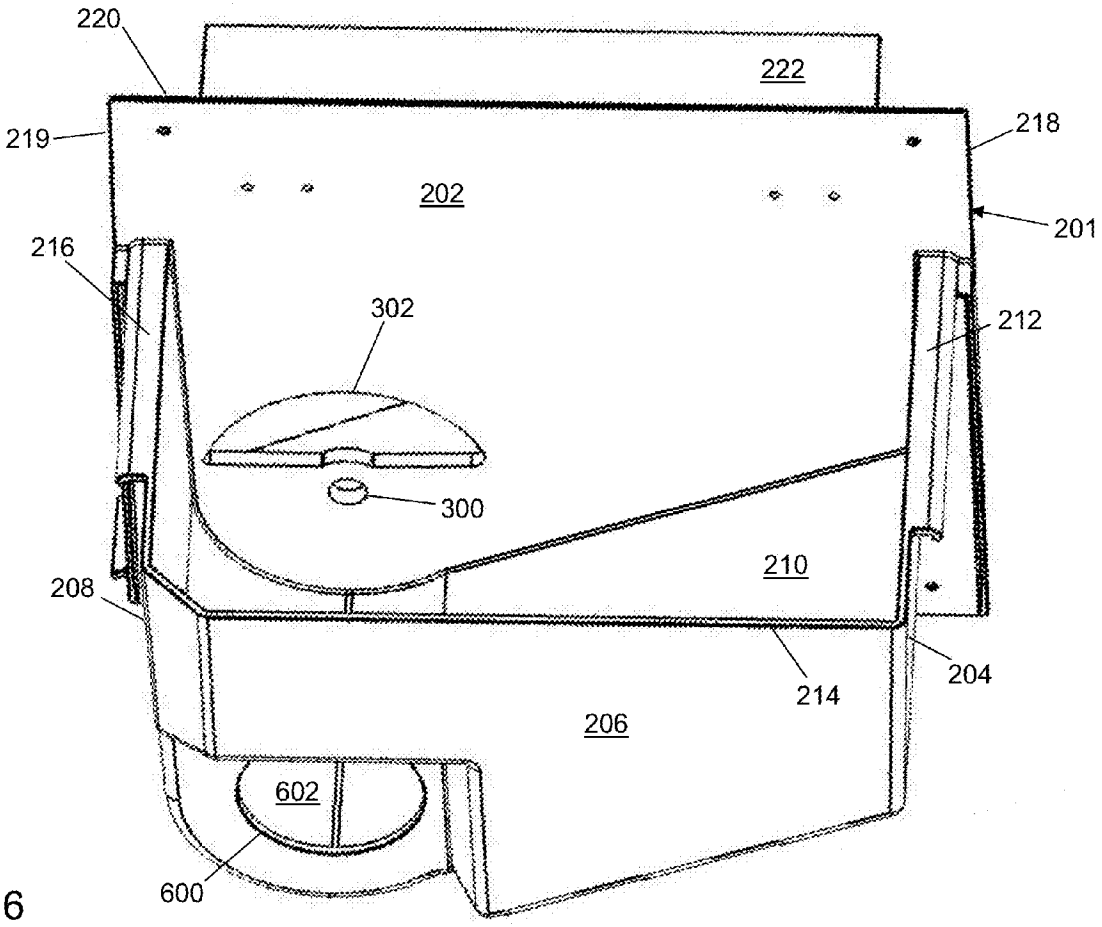
FIG. 6 depicts a top, back perspective view of an ice receptacle of the ice dispenser of FIG. 2 in accordance with an illustrative embodiment.
Figure 7:
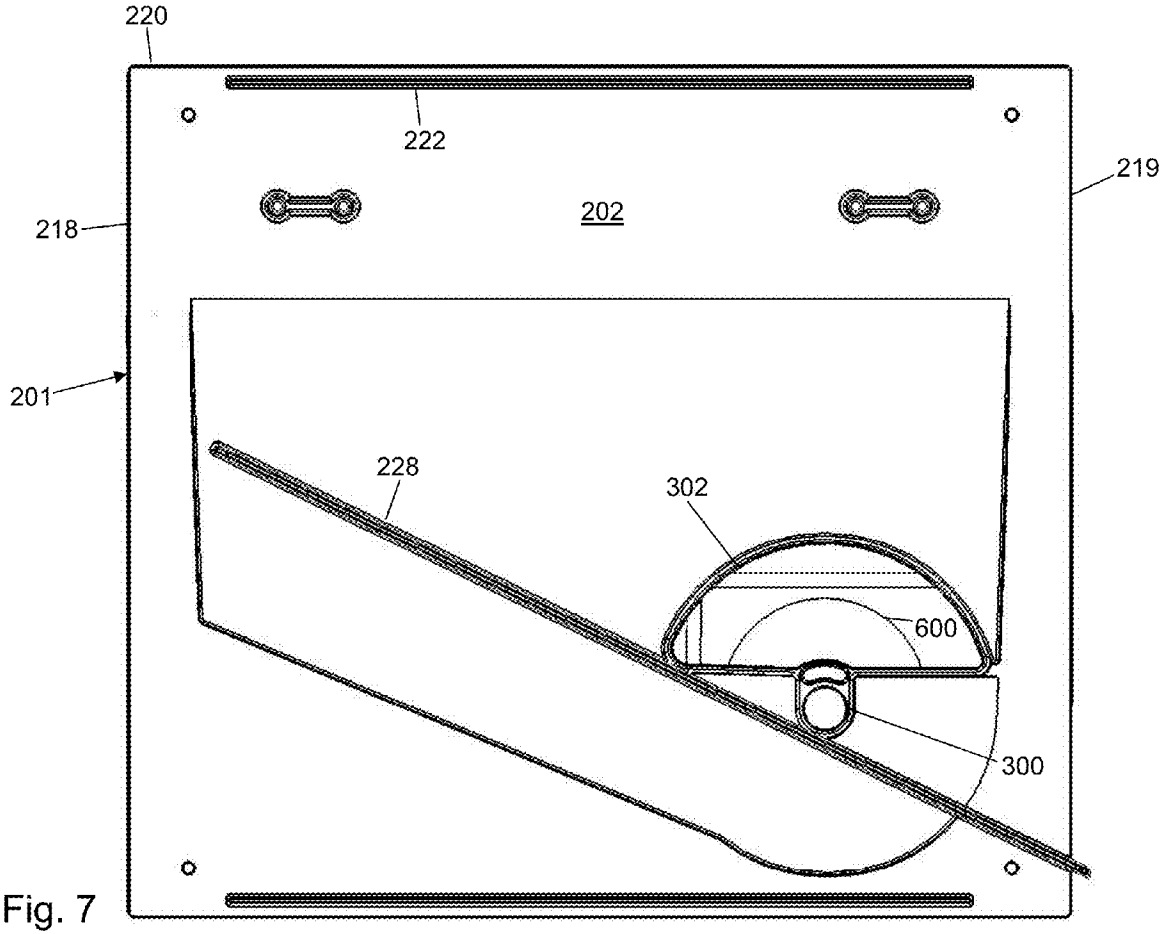
FIG. 7 depicts a front view of the ice receptacle of FIG. 6 in accordance with an illustrative embodiment.

With reference to FIG. 6, a top, back perspective view of ice receptacle 201 is shown in accordance with an illustrative embodiment. With reference to FIG. 7, a front view of ice receptacle 201 is shown in accordance with an illustrative embodiment. With continuing reference to FIG. 2 and in the illustrative embodiment, ice receptacle 201 includes a front wall 202, a left side wall 204, a back wall 206, a right side wall 208, and a bottom wall 210, which form a generally rectangular collection area for the ice cubes though ice receptacle 201 may have other polygonal and spherical shapes in alternative embodiments. A top edge 212 of left side wall 204, a top edge 214 of back wall 206, a top edge 216 of right side wall 208, and front wall 202 form an ice receiving aperture. In the illustrative embodiment, the ice maker (not shown) is positioned above the ice receiving aperture to discharge ice into ice receptacle 201. In alternative embodiments, the ice maker need not be positioned above the ice receiving aperture. For example, the ice maker may be positioned adjacent a side wall of ice receptacle 201.

Ice receptacle 201 may be slideably mounted within the freezer space on rails mounted to one or more of the walls of device 100 such that ice receptacle 201 is removable from device 100. In the illustrative embodiment, front wall 202 includes a left side edge 218, a right side edge 219, and a top edge 220. Top edge 220 of front wall 202 extends between left side edge 218 and right side edge 219. Left side edge 218 and right side edge 219 of front wall 202 extend above top edge 212 of left side wall 204 and top edge 216 of right side wall 208 forming a front face that may be positioned to abut the ice maker to ensure that ice receptacle 201 is properly positioned in relation to an ice discharge area of the ice maker. A handle 222 may extend from top edge 220 of front wall 202 to facilitate removal of ice receptacle 201 from device 100. A first protrusion 224 and a second protrusion 226 extend from front wall 202 in a direction towards back wall 206 of ice receptacle 201. First protrusion 224 and second protrusion 226 may further facilitate the proper positioning and mounting of ice receptacle 201 in relation to the ice discharge area of the ice maker.

With continuing reference to FIGS. 2-5, ice dispenser 200 further may include an auger 230 having a first end 232, a shaft 235, and one or more flights 233 between first end 232 and shaft 235. The one or more flights 233 may be spiral or helical in shape and define at least one complete 360 degree flight. In an illustrative embodiment, auger 230 is formed of a single piece of material such as stainless steel. Shaft 235 extends from the one or more flights 233 in a direction of an axis of rotation of the one or more flights 233. First end 232 fixedly mounts auger 230 to an auger cap 234 by extending through a hole 1502 (shown with reference to FIG. 15) in auger cap 234 though other mounting methods may be used in alternative embodiments. Auger cap 234 is mounted in an auger cap aperture 600 (shown with reference to FIG. 6) formed in back wall 206. Shaft 235 extends through a shaft aperture 300 in front wall 202 of ice receptacle 201. Rotation of auger 230 by an actuator (not shown) mounted to rotate auger cap 234 conveys ice on demand through a wheel 236, which is mounted to shaft 235. In an alternative embodiment, first end 232 may be directly mounted to a rotational shaft of the actuator. When rotationally driven by the actuator, the one or more flights 233 of auger 230 engage ice cubes received into ice receptacle 201 and push the engaged ice cubes toward wheel 236. In the illustrative embodiment, bottom wall 210 is sloped downwards toward a collection area 602 (shown with reference to FIG. 6) of ice receptacle 201 and auger 230.

Wheel 236 is mounted to auger 230 to rotate with shaft 235. Wheel 236 includes a plurality of curved vanes 800 (shown with reference to FIG. 8), which facilitate movement of the ice cubes through a receptacle aperture 302 and onto a chute 228. Receptacle aperture 302 is formed in front wall 202 of ice receptacle 201. Chute 228 is mounted to extend from front wall 202 exterior to collection area 602 of ice receptacle 201. In the illustrative embodiment, chute 228 slopes downward toward a lower right corner of front wall 202 to allow gravity to assist in the delivery of the ice cubes. Of course, chute 228 may slope downwards toward a lower left corner of front wall 202 in an alternative embodiment. From chute 228, the ice cubes may be dispensed into a container for consumption in a variety of manners. For illustration, chute 228 may provide the ice cubes to a dispensing mechanism such as that described in U.S. Pat. No. 5,211,462 titled DOUBLE DOOR REFRIGERATOR WITH ICE SERVICE THROUGH THE REFRIGERATOR DOOR and issued May 18, 1993 and/or in U.S. Pat. No. 7,814,762 titled INTEGRATED ICE DISPENSER SWITCH and issued Oct. 19, 2010.

Ice dispenser 200 further may include an adapter 238 and an ice agitator 240. Adapter 238 mounts ice agitator 240 to shaft 235 of auger 230 such that rotation of auger 230 causes translational motion of ice agitator 240 in a plane that is perpendicular to the axis of rotation of shaft 235. Adapter 238 rotates with shaft 235 of auger 230, which rotates through 360 degrees. A center of rotation of adapter 238 rotates about shaft 235. Ice agitator 240 is not mounted to rotate with adapter 238. As a result, in an illustrative embodiment, rotation of ice agitator 240 with adapter 238 is incidental to the translational motion of ice agitator 240 relative to shaft 235, which results from the rotation of the center of rotation of adapter 238 about shaft 235.

Figure 8:
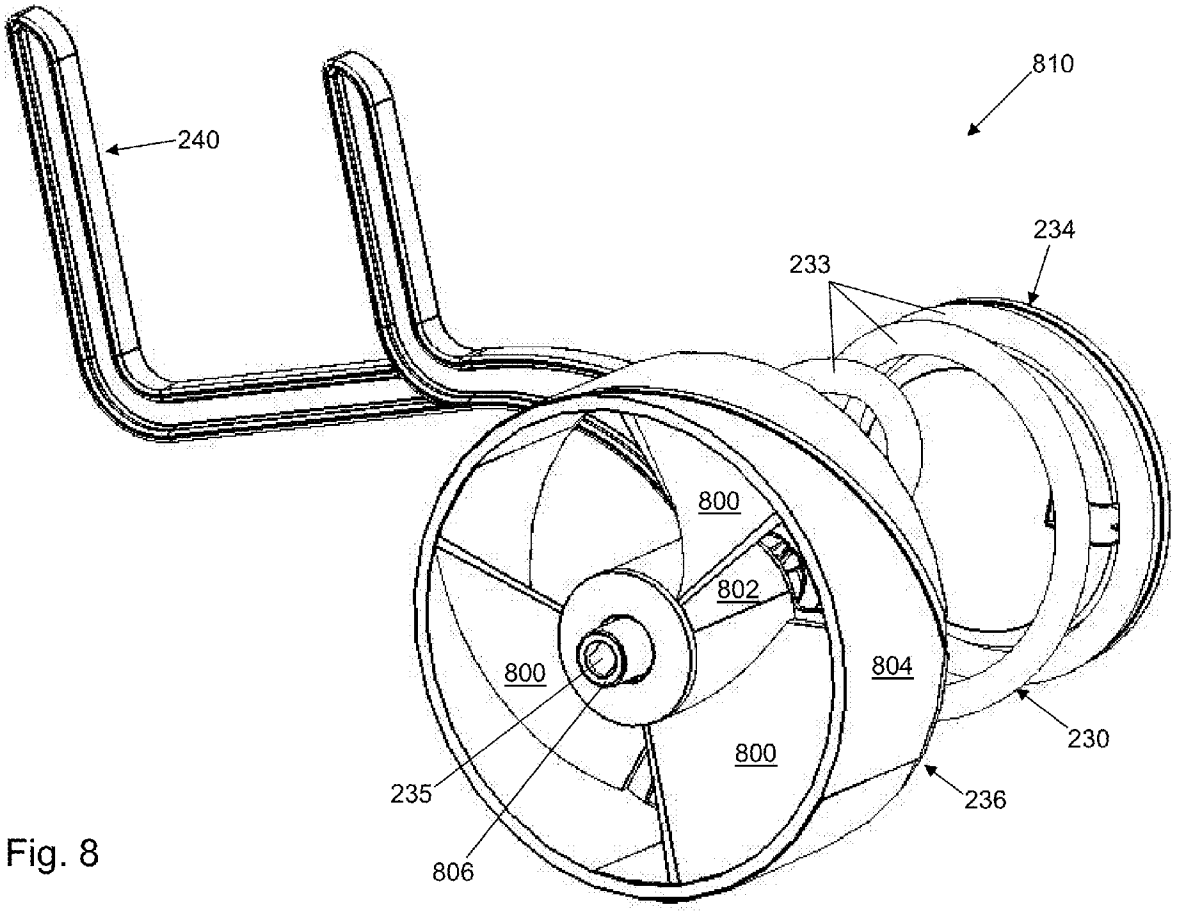
FIG. 8 depicts a front perspective view of an auger system of the ice dispenser of FIG. 2 in accordance with an illustrative embodiment.
Figure 9:
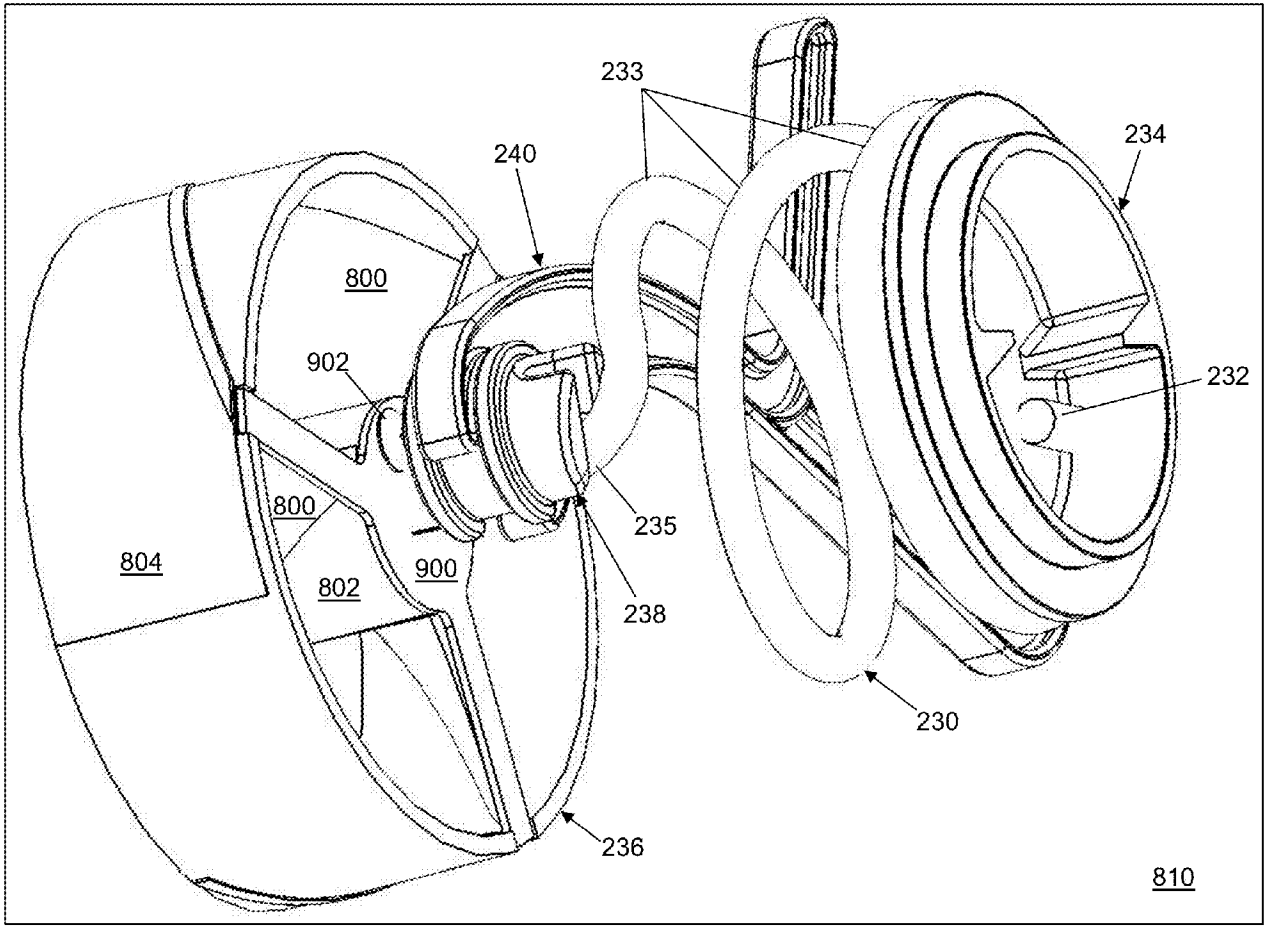
FIG. 9 depicts a right side perspective view of the auger system of FIG. 8 in accordance with an illustrative embodiment.
Figure 10:
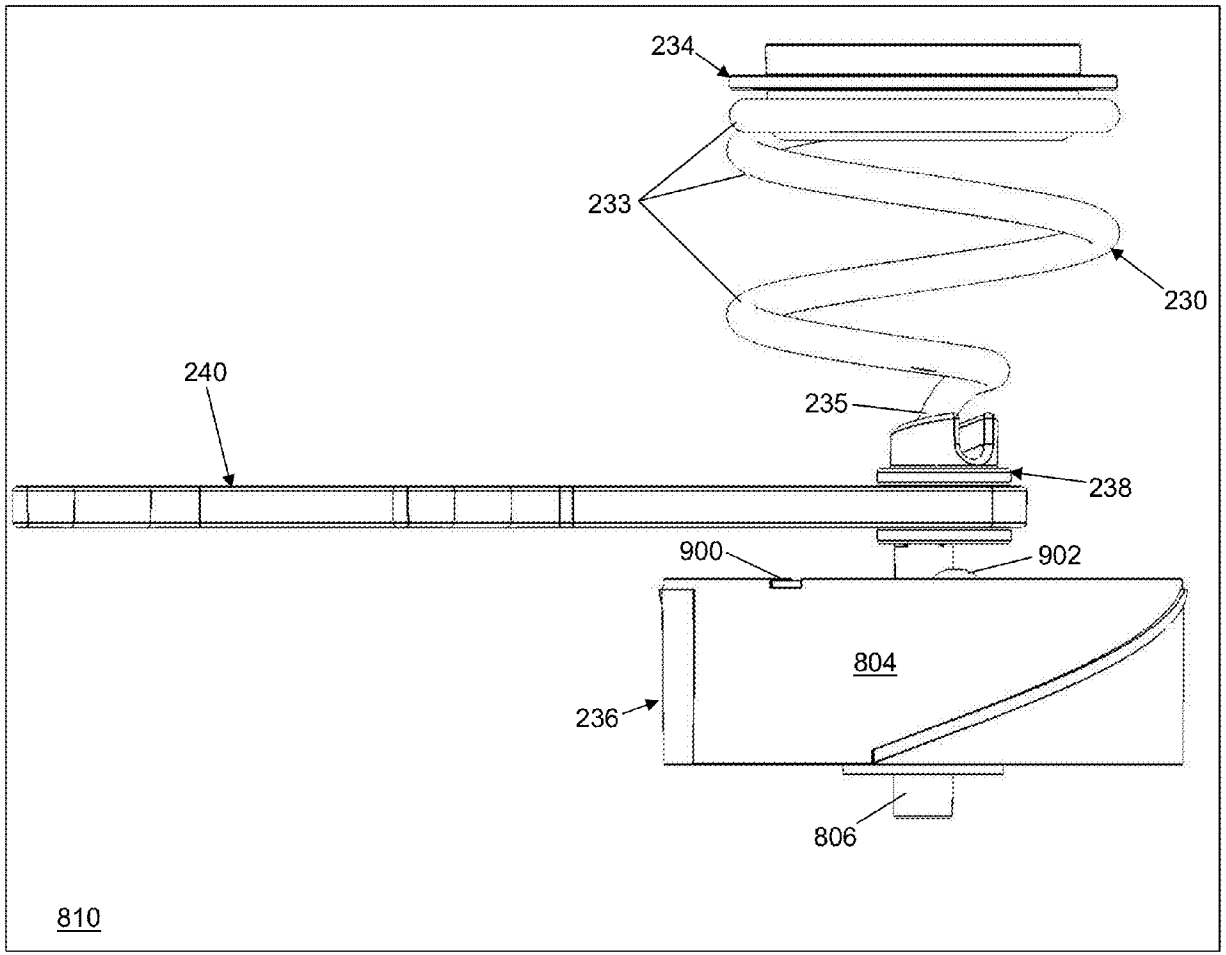
FIG. 10 depicts a top view of the auger system of FIG. 8 in accordance with an illustrative embodiment.
Figure 13:
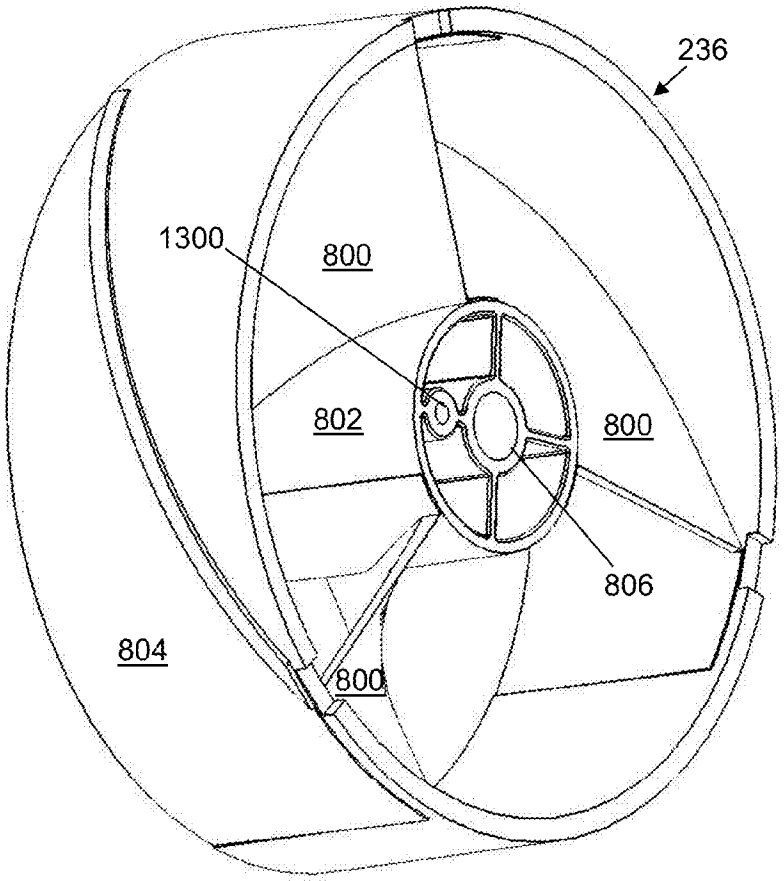
FIG. 13 depicts a back perspective view of a wheel of the auger system of FIG. 8 in accordance with an illustrative embodiment.

With reference to FIG. 8, a top, front perspective view of an auger system 810 of ice dispenser 200 is shown in accordance with an illustrative embodiment. With reference to FIG. 9, a right side perspective view of auger system 810 of ice dispenser 200 is shown in accordance with an illustrative embodiment. With reference to FIG. 10, a top view of auger system 810 of ice dispenser 200 is shown in accordance with an illustrative embodiment. With reference to FIG. 13, a back perspective view of wheel 236 is shown in accordance with an illustrative embodiment.

With continuing reference to FIG. 8, wheel 236 includes the plurality of curved vanes 800, a vane core 802, a vane disk 804, a wheel core 806, and a mounting aperture 1300 (shown with reference to FIG. 13). Vane core 802, vane disk 804, and wheel core 806 form tubes. Vane core 802 has a smaller radius than vane disk 804, and wheel core 806 has a smaller radius than vane core 802 such that wheel core 806 fits within vane core 802, which fits within vane disk 804. Vane core 802, vane disk 804, and wheel core 806 have a common center through which shaft 235 is inserted. The plurality of curved vanes 800 are mounted between vane core 802 and vane disk 804.

Figure 14:
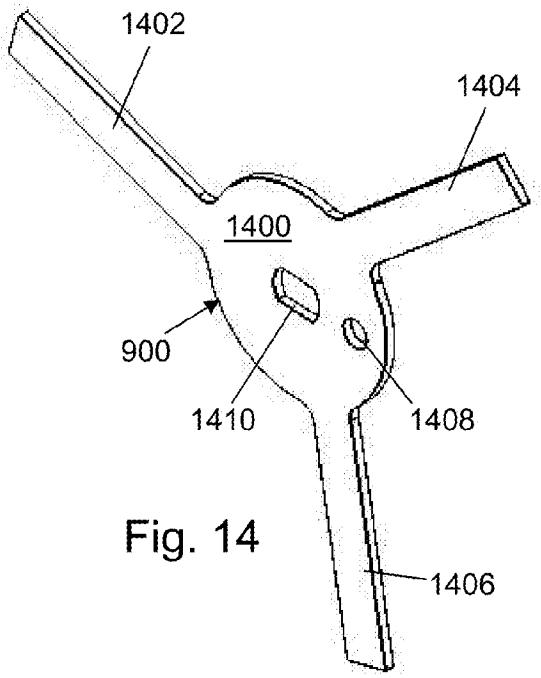
FIG. 14 depicts a front perspective view of a bracket of the auger system of FIG. 8 in accordance with an illustrative embodiment.

With continuing reference to FIGS. 9 and 10, a bracket 900 mounts shaft 235 to wheel 236 using a screw 902 inserted in mounting aperture 1300 though other mounting methods may be used. With reference to FIG. 14, a perspective view of bracket 900 is shown in accordance with an illustrative embodiment. In the illustrative embodiment, bracket 900 may include a core 1400, a first arm 1402, a second arm 1404, a third arm 1406, a screw aperture 1408, and a shaft aperture 1410. Core 1400 is sized and shaped to cover an end of vane core 802. First arm 1402, second arm 1404, and third arm 1406 radiate from core 1400 and align with a respective end of each of the plurality of vanes 800 when screw aperture 1408 is aligned with mounting aperture 1300 of wheel 236 for insertion of screw 902. The ends of first arm 1402, second arm 1404, and third arm 1406 opposite core 1400 mount to vane disk 804. Shaft aperture 1410 is sized and shaped to accept shaft 235 so that wheel 236 and bracket 900 rotate with shaft 235 under control of the actuator.

Figure 11:
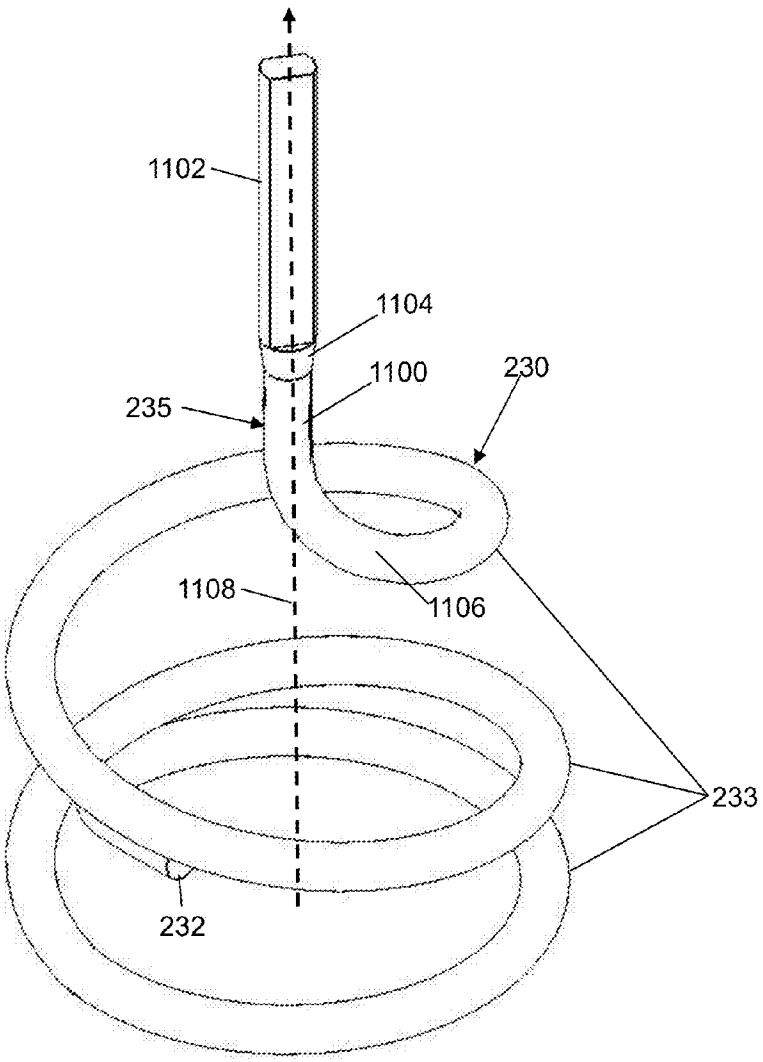
FIG. 11 depicts a first perspective view of an auger of the auger system of FIG. 8 in accordance with an illustrative embodiment.
Figure 12:
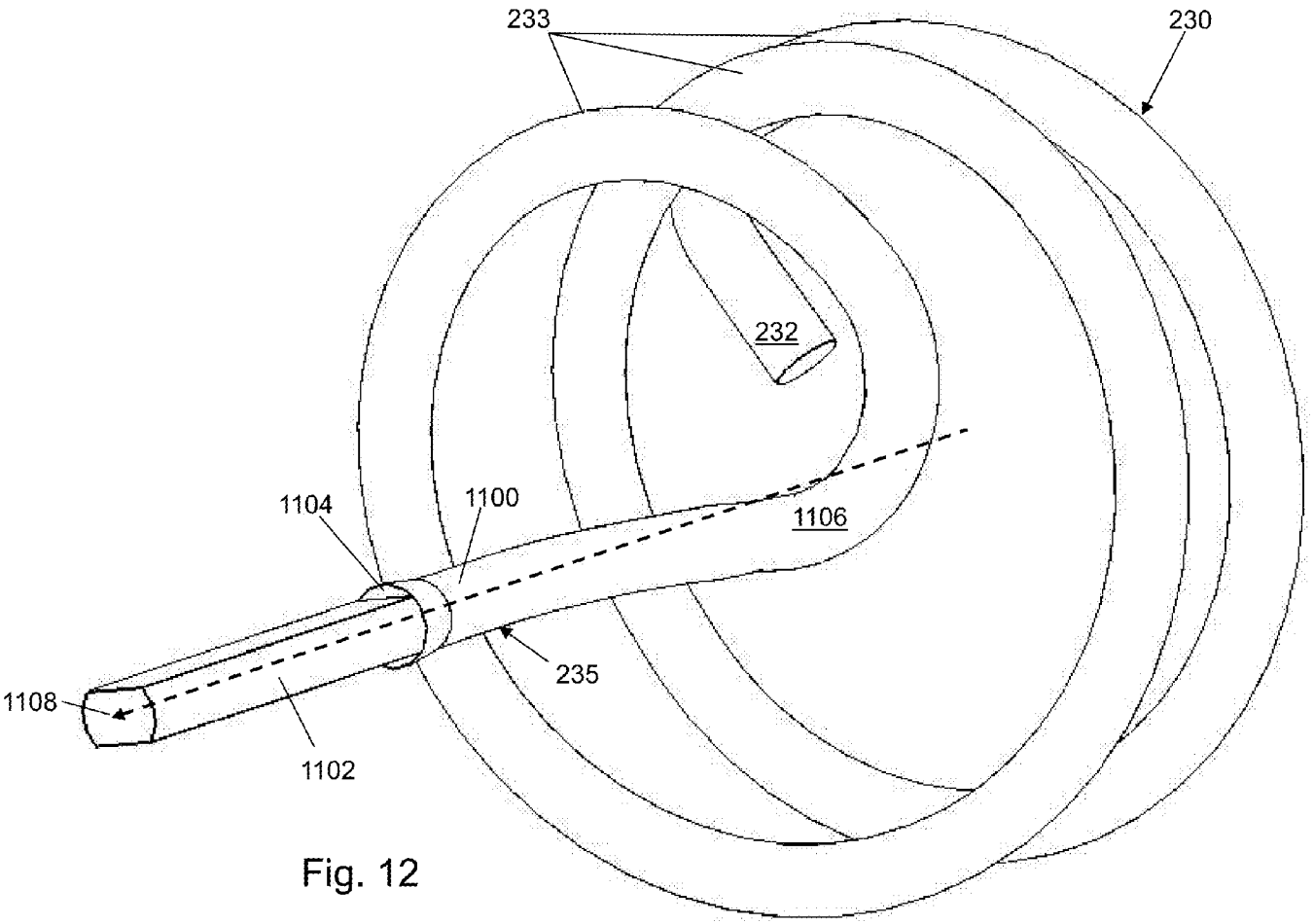
FIG. 12 depicts a second perspective view of the auger of FIG. 11 in accordance with an illustrative embodiment.

With reference to FIGS. 11 and 12, perspective views of auger 230 are shown in accordance with an illustrative embodiment. Shaft 235 includes a first section 1100, a second section 1102, and a shaft transition section 1104. A transition section 1106 extends between shaft 235 and the one or more flights 233. Transition section 1106 is a curved section connecting an endpoint of the one or more flights 233 and shaft 235. First section 1100 has a circular cross section that has a similar cross sectional dimension to transition section 1106 and the one or more flights 233 though this is not required. Second section 1102 has a non-circular shape so that bracket 900, and thereby wheel 236, rotates with auger 230. For example, in the illustrative embodiment, second section 1102 of shaft 235 has an oblong cross section with two parallel straight edges and curved edges between the two parallel straight edges. Shaft transition section 1104 mounts first section 1100 to second section 1102. Of course, auger 230 may be formed of a single piece of material, for example, by molding.

Shaft 235 extends in a direction 1108 that is parallel to and may coincide with an axis of rotation of the one or more flights 233. Shaft 235 and wheel 236 rotate about the axis defined by direction 1108. As shown with reference to FIGS. 11 and 12, direction 1108 defines a center of shaft 235 and the axis of rotation of shaft 235.

Figure 15:
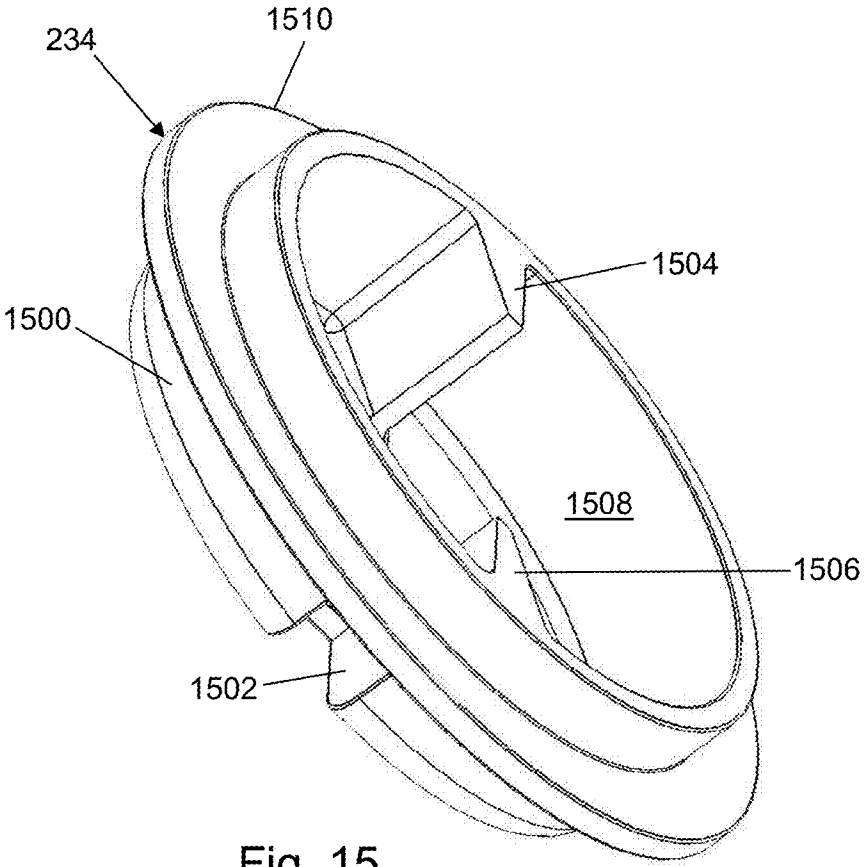
FIG. 15 depicts a back perspective view of an auger cap of the auger system of FIG. 8 in accordance with an illustrative embodiment.

With reference to FIG. 15, a perspective view of auger cap 234 is shown in accordance with an illustrative embodiment. Auger cap 234 may include a disk body 1500, hole 1502, a first engagement protrusion 1504, a second engagement protrusion 1506, and an outer disk 1510. Disk body 1500 has a generally circular shape that is sized to fit within auger cap aperture 600. First end 232 of auger 230 is positioned within hole 1502 to mount auger 230 to auger cap 234. A flight of the one or more flights 233 may also be positioned to at least partially encircle disk body 1500. First engagement protrusion 1504 and second engagement protrusion 1506 protrude from an interior surface of disk body 1500 and provide engagement points for rotating auger cap 234 under control of the actuator and thereby rotating auger 230, bracket 900, and wheel 236. Outer disk 1510 extends from an exterior surface of disk body 1500 to maintain auger cap 234 in position and to keep auger cap 234 from passing through auger cap aperture 600 and into the interior of ice receptacle 201.

Figure 16:
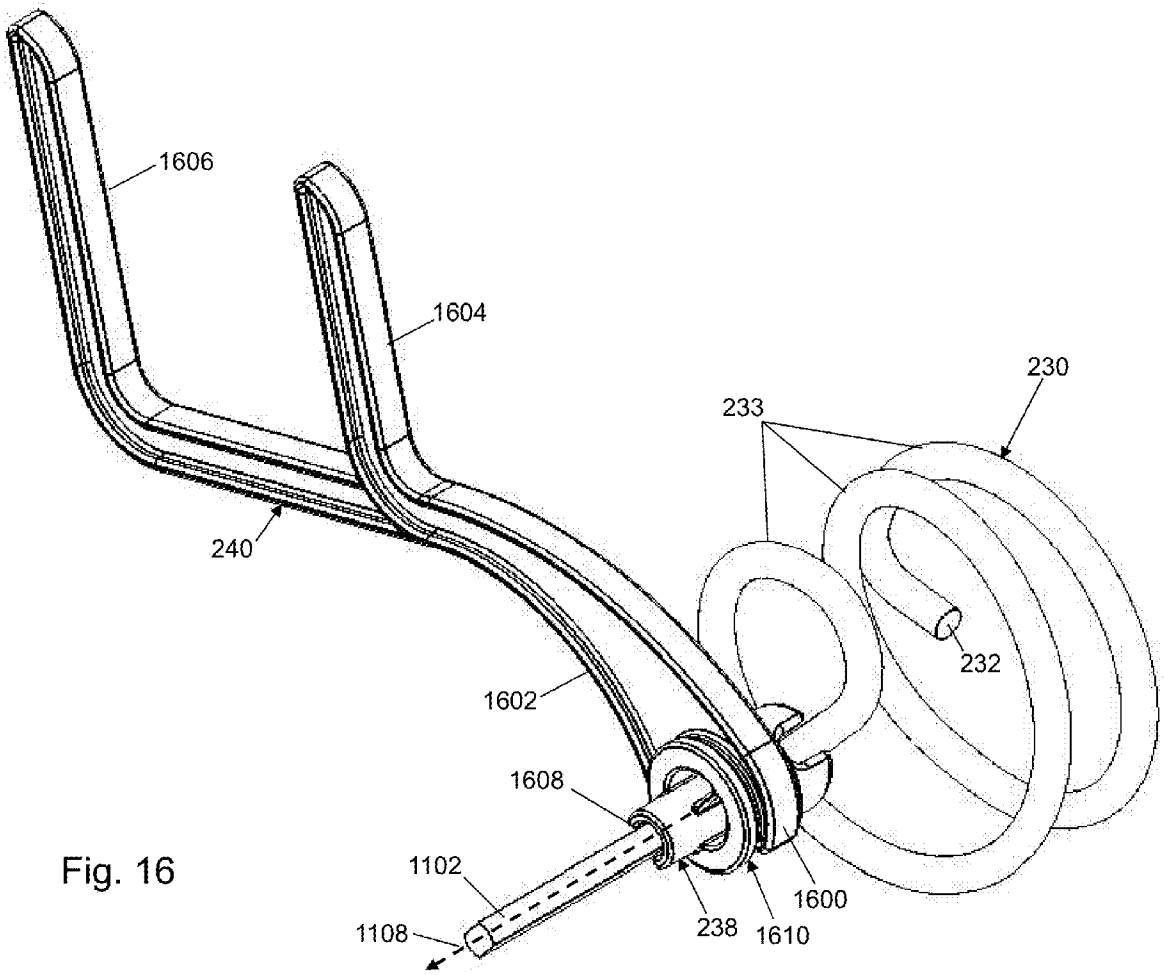
FIG. 16 depicts a front perspective view of an adaptor, an ice agitator, and the auger of the auger system of FIG. 8 in accordance with an illustrative embodiment.
Figure 17:
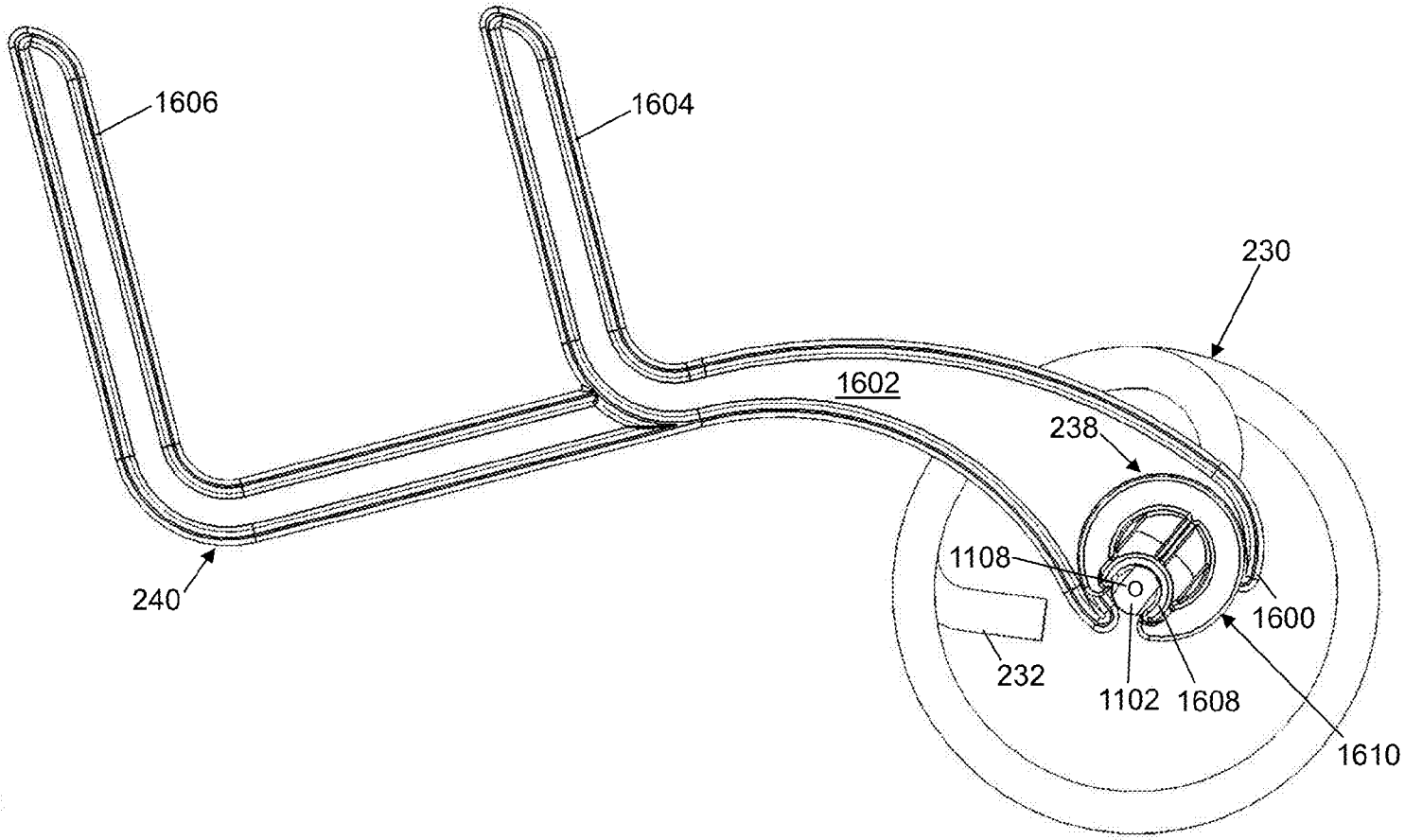
FIG. 17 depicts a front view of the adaptor, the ice agitator, and the auger of FIG. 16 in accordance with an illustrative embodiment.
Figure 18:
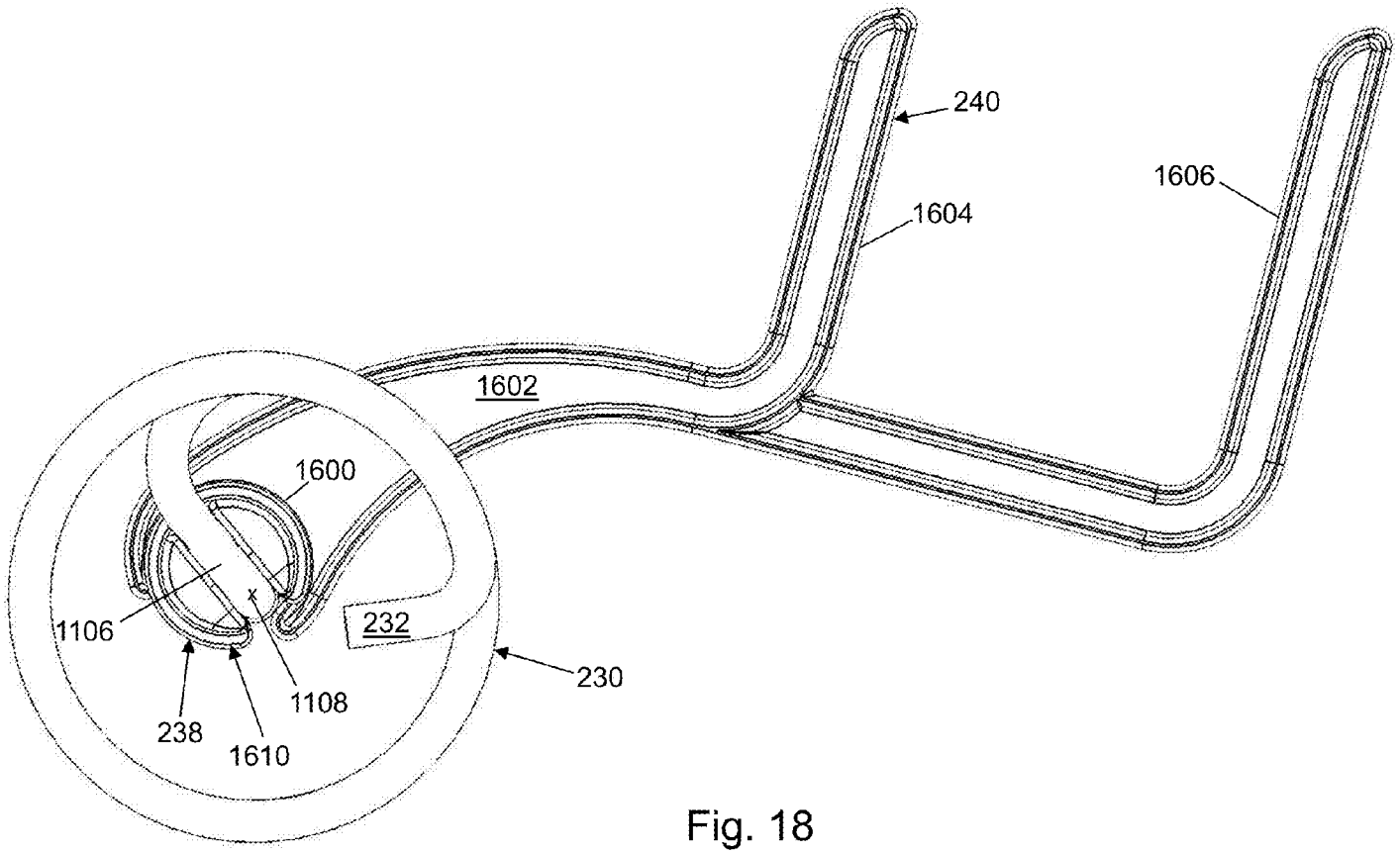
FIG. 18 depicts a back view of the adaptor, the ice agitator, and the auger of FIG. 16 in accordance with an illustrative embodiment.
Figure 19:
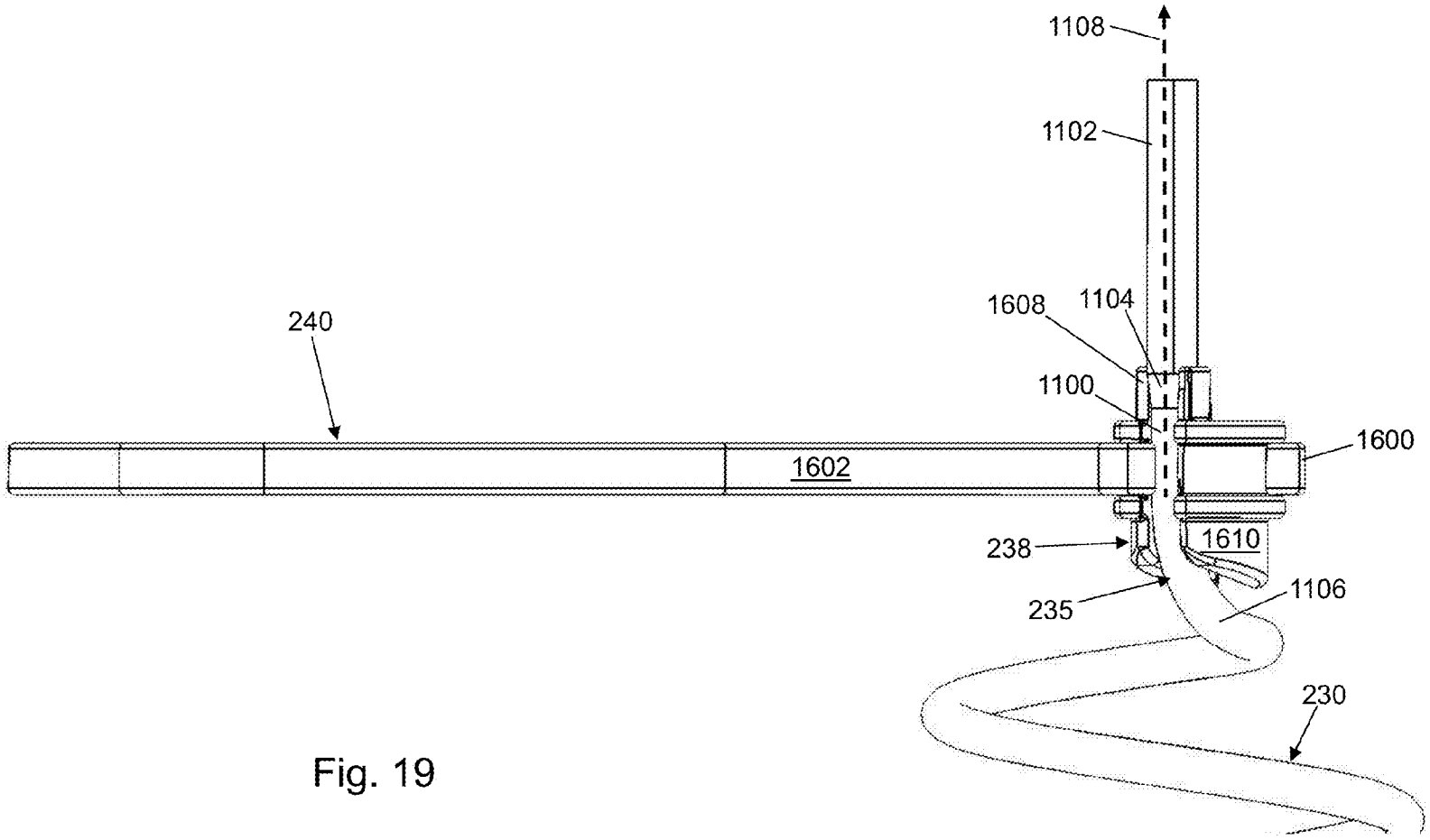
FIG. 19 depicts a top view of the adaptor, the ice agitator, and the auger of FIG. 16 in accordance with an illustrative embodiment.

With reference to FIG. 16, a top, front perspective view of ice agitator 240, adaptor 238, and auger 230 is shown in accordance with an illustrative embodiment. With reference to FIG. 17, a front view of ice agitator 240, adaptor 238, and auger 230 is shown in accordance with an illustrative embodiment. With reference to FIG. 18, a back view of ice agitator 240, adaptor 238, and auger 230 is shown in accordance with an illustrative embodiment. With reference to FIG. 19, a bottom view of ice agitator 240, adaptor 238, and auger 230 is shown in accordance with an illustrative embodiment. Ice agitator 240 is mounted to adaptor 238, and adaptor 238 is mounted to shaft 235 of auger 230.

Ice agitator 240 includes a hook 1600 and an arm 1602 that extends from hook 1600 away from direction 1108, the axis of rotation of shaft 235. In the illustrative embodiment of FIGS. 16-19, hook 1600 forms a partially closed loop that extends partially around a disk portion 1610 of adaptor 238 to mount hook 1600 to adaptor 238. In the illustrative embodiment of FIGS. 16-19, ice agitator 240 further includes a first finger 1604 and a second finger 1606 that extend from arm 1602 at an end of arm 1602 opposite hook 1600. First finger 1604 and second finger 1606 are distributed along arm 1602 to extend up from arm 1602 at different radial distances from shaft 235 of auger 230. Arm 1602 is curved upward from hook 1600 when hook 1600 is mounted to disk portion 1610.

Adaptor 238 may include disk portion 1610 and an auger mounting channel 1608. A portion of shaft 235 is positioned to fit within auger mounting channel 1608 such that adaptor 238 rotates with shaft 235 of auger 230. Auger mounting channel 1608 may be formed in or through disk portion 1610. Thus, adaptor 238 may be a molded piece of material. First section 1100 and/or a portion of shaft transition section 1104 may fit within auger mounting channel 1608. Auger mounting channel 1608 extends in a direction parallel to direction 1108. Auger mounting channel 1608 is further offset from an axis of rotation defined through a center axis 2100 (shown with reference to FIG. 21) of a mounting disk 2000 (shown with reference to FIG. 20) formed by disk portion 1610. Hook 1600 is mounted to disk 2000 such that hook 1600 primarily translates when adaptor 238 rotates with shaft 235 of auger 230.

Figure 20:
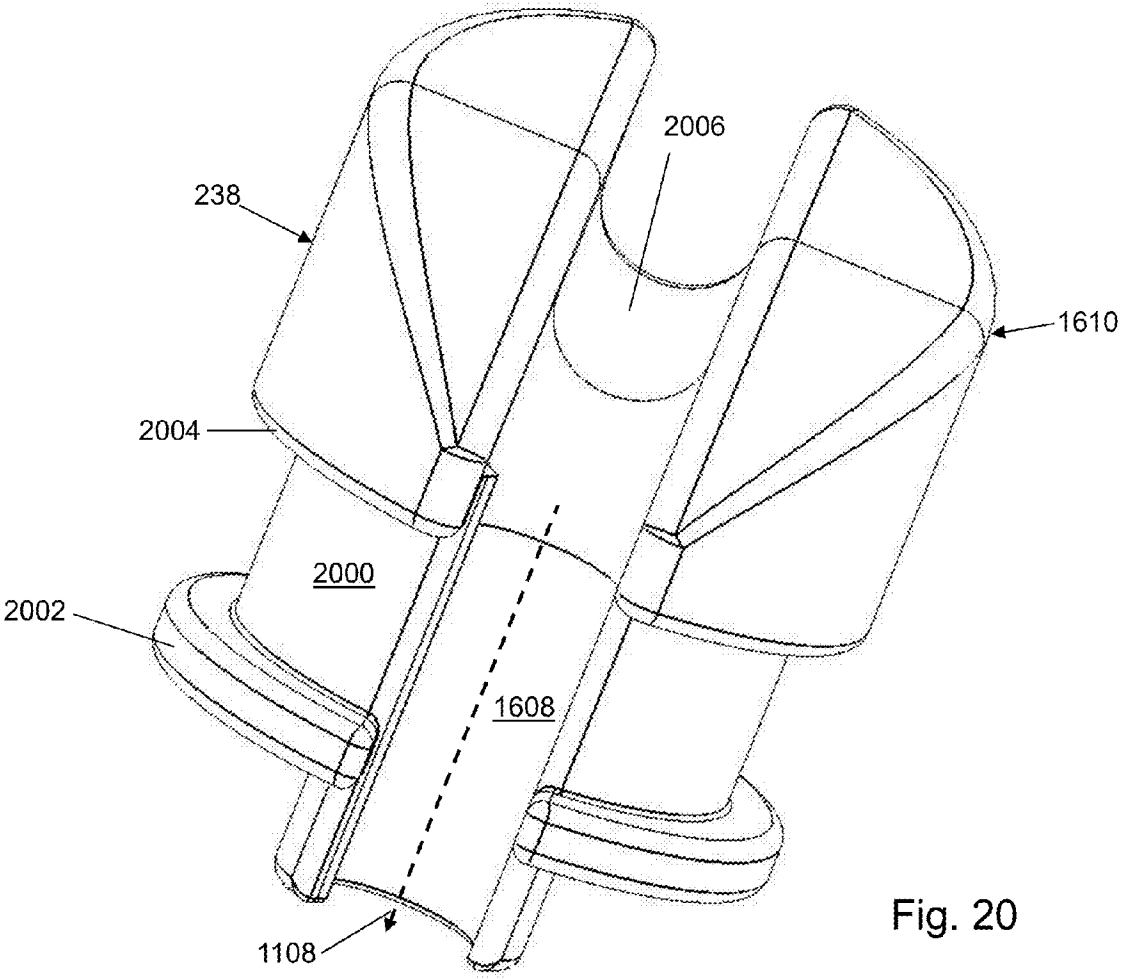
FIG. 20 depicts a top perspective view of the adaptor of FIG. 16 in accordance with a first illustrative embodiment.
Figure 21:
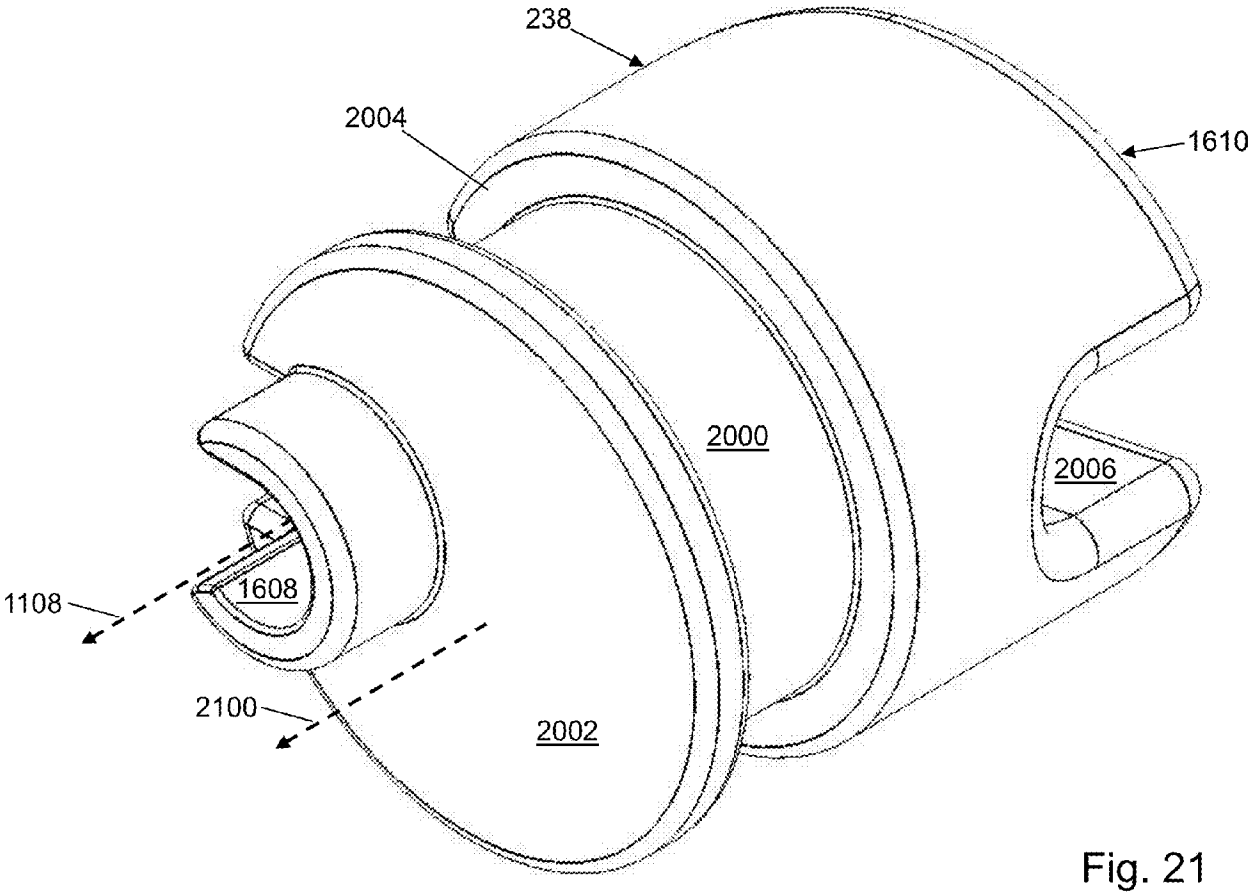
FIG. 21 depicts a bottom, front perspective view of the adaptor of FIG. 20 in accordance with a first illustrative embodiment.
Figure 22:
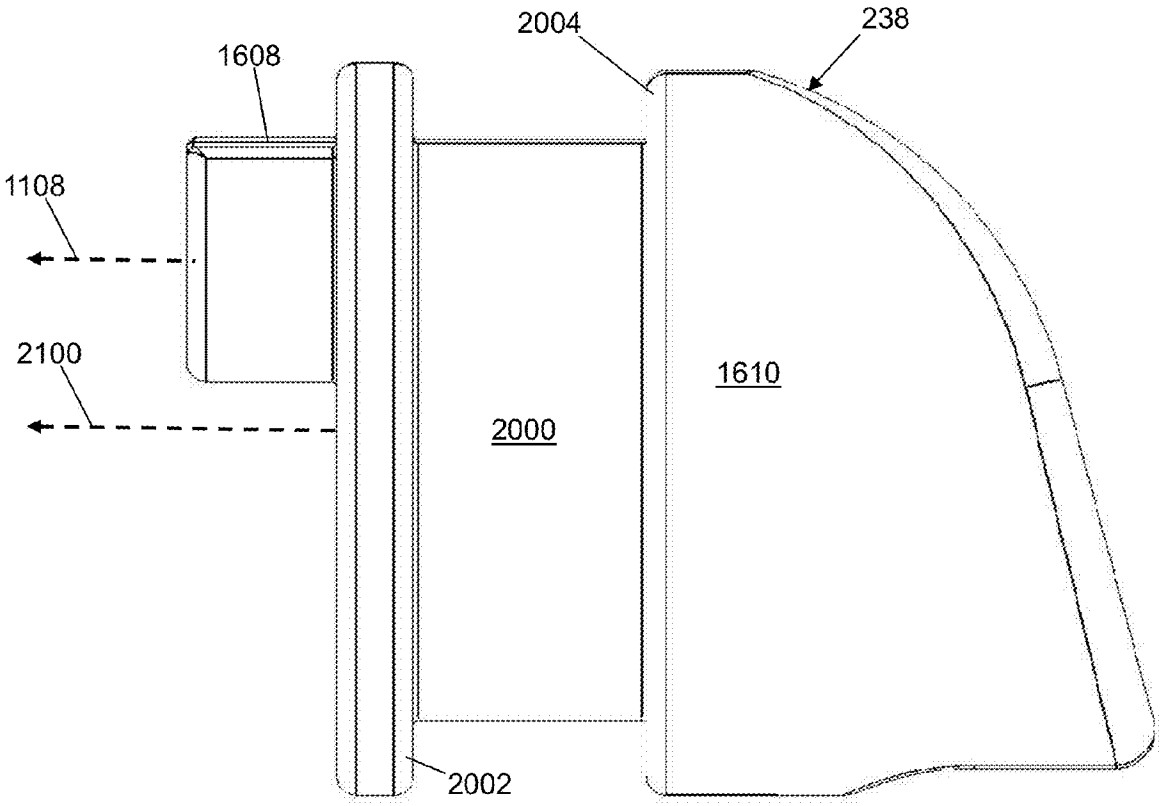
FIG. 22 depicts a side view of the adaptor of FIG. 20 in accordance with a first illustrative embodiment.
Figure 23:
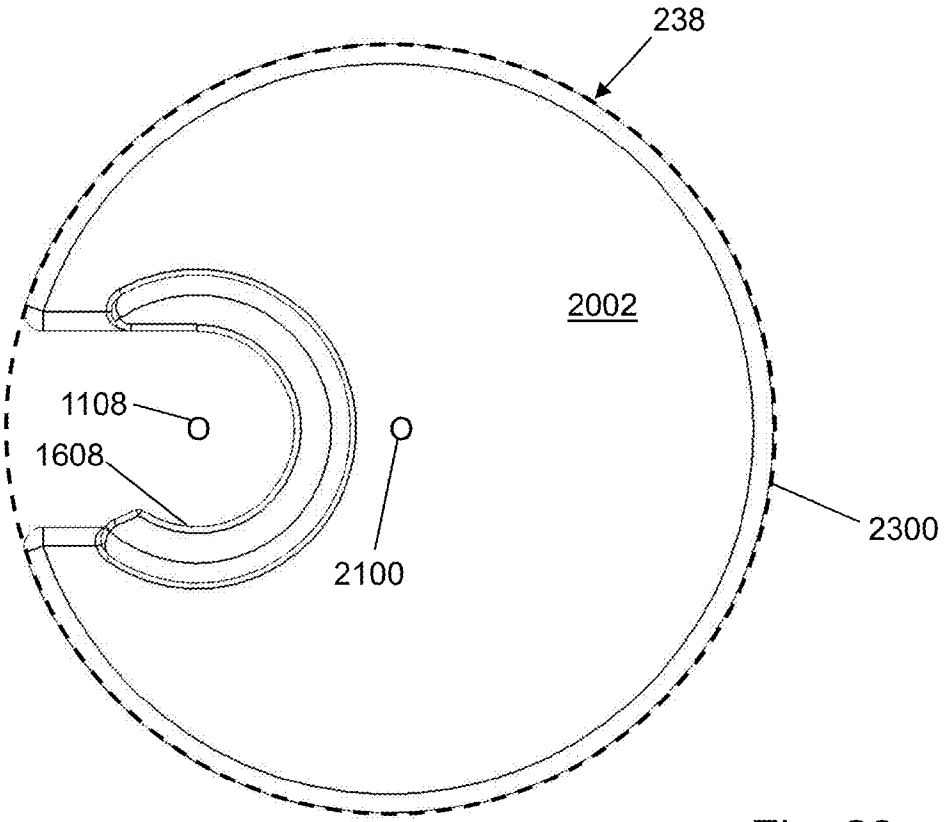
FIG. 23 depicts a front view of the adaptor of FIG. 20 in accordance with a first illustrative embodiment.

With reference to FIG. 20, a top perspective view of adaptor 238 is shown in accordance with a first illustrative embodiment. With reference to FIG. 21, a front perspective view of adaptor 238 is shown in accordance with the first illustrative embodiment. With reference to FIG. 22, a side view of adaptor 238 is shown in accordance with the first illustrative embodiment. With reference to FIG. 23, a front view of adaptor 238 is shown in accordance with the first illustrative embodiment. With reference to FIG. 23, adaptor 238 is viewed with direction 1108 coming out of the page along a longitudinal axis of auger mounting channel 1608.

With reference to FIGS. 20-23, disk portion 1610 includes mounting disk 2000, a first disk 2002, a second disk 2004, and a second mounting channel 2006. Hook 1600 is mounted to mounting disk 2000. A first radius of mounting disk 2000 is less than a second radius of first disk 2002, and the first radius of mounting disk 2000 is less than a third radius of second disk 2004. A groove is formed when mounting disk 2000 is mounted between first disk 2002 and second disk 2004. Hook 1600 is configured to fit in the groove formed in a periphery of disk portion 1610 between first disk 2002 and second disk 2004. Direction 1108 defines a longitudinal axis of auger mounting channel 1608. Second mounting channel 2006 extends at an angle from auger mounting channel 1608. The angle generally corresponds to the angle defined between first section 1100 of shaft 235 and transition section 1106 of auger 230 so that adaptor 238 can be positioned to abut transition section 1106 of auger 230 though this is not required.

Center axis 2100 of mounting disk 2000, of first disk 2002, and of second disk 2004 of disk portion 1610 extends in a direction parallel to and offset from direction 1108 defined through the center of shaft 235 of auger 230 when shaft 235 is positioned within auger mounting channel 1608. Center axis 2100 of disk portion 1610 is a center of a circle 2300 circumscribed about a peripheral edge of first disk 2002 which is also a center of a second circle (not shown) circumscribed about a peripheral edge of mounting disk 2000. Of course, adaptor 238 may be formed of a single piece of material, for example, by molding.

In the illustrative embodiment of FIGS. 20-23, auger mounting channel 1608 is a trough formed in a circumferential edge of mounting disk 2000, first disk 2002, and second disk 2004 of disk portion 1610 such that disk portion 1610 forms a c-shape when adaptor 238 is viewed along the longitudinal axis of auger mounting channel 1608 as shown with reference to FIG. 23. When shaft 235 of auger 230 rotates, center axis 2100 rotates about shaft 235 of auger 230 positioned in auger mounting channel 1608. As a result, hook 1600, which is mounted to mounting disk 2000, translates in a translation direction perpendicular to direction 1108 to break up any ice that has become stuck together in ice receptacle 201. Though there may be incidental rotation of hook 1600 with adaptor 238, the primary motion is in the translation direction when adaptor 238 rotates with shaft 235 of auger 230.

Figure 24:
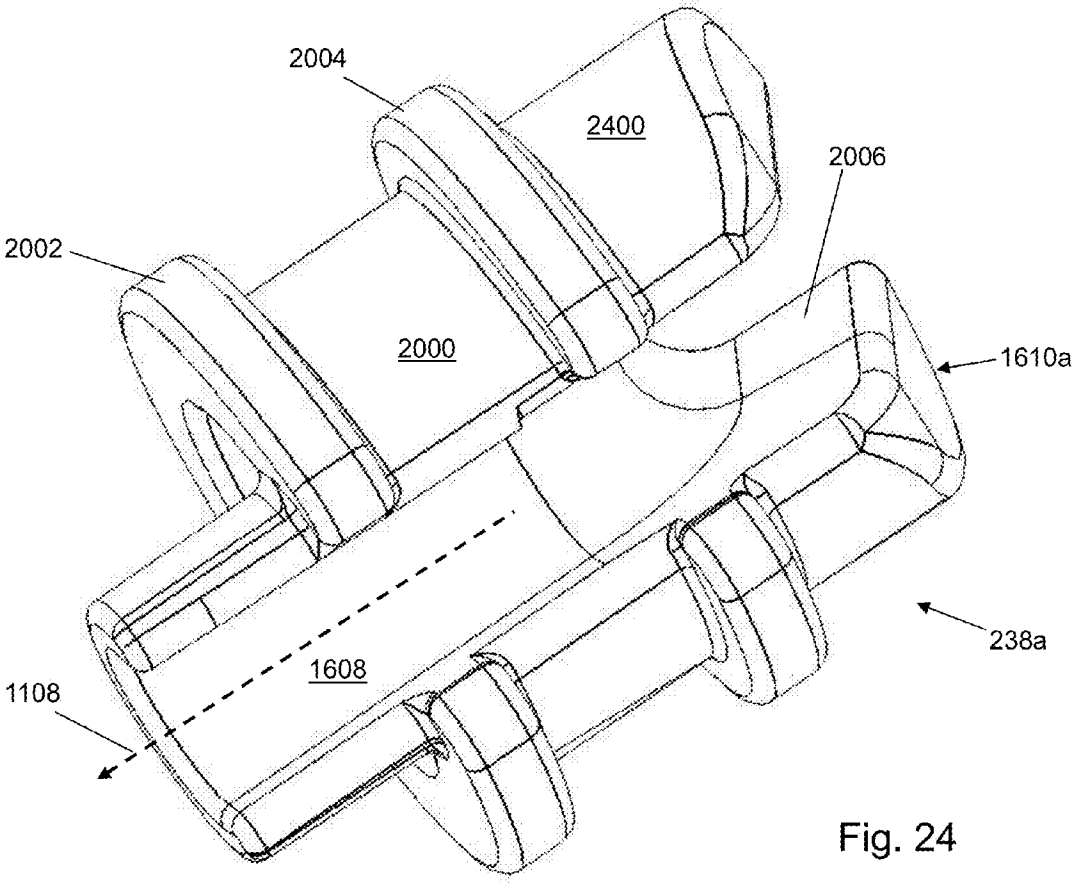
FIG. 24 depicts a top perspective view of a second adaptor in accordance with a second illustrative embodiment.
Figure 25:
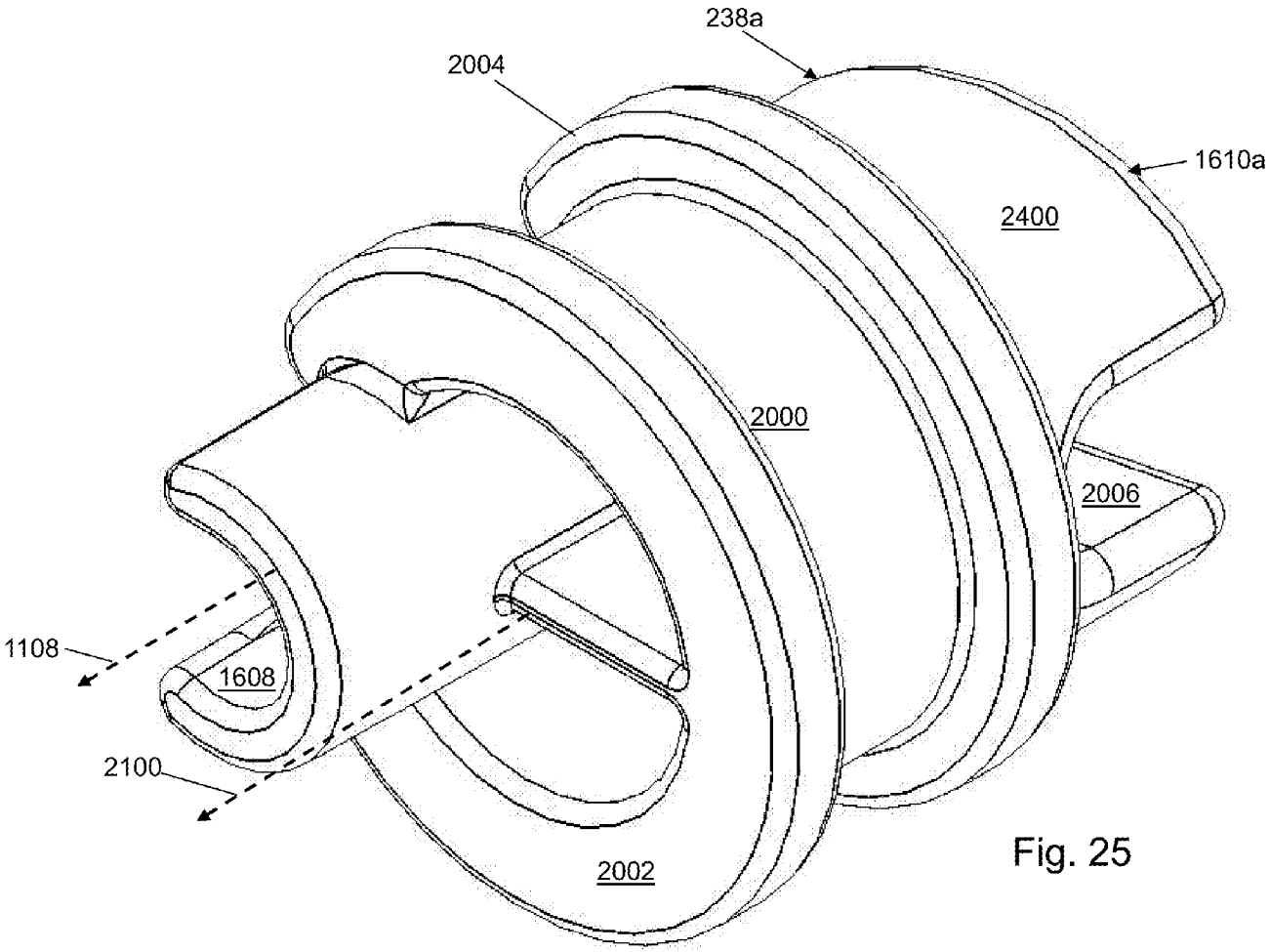
FIG. 25 depicts a bottom, front perspective view of the second adaptor of FIG. 24 in accordance with a second illustrative embodiment.

With reference to FIG. 24, a top perspective view of a second adaptor 238*a* is shown in accordance with a second illustrative embodiment. With reference to FIG. 25, a front perspective view of second adaptor 238*a* is shown in accordance with the second illustrative embodiment. Similar to adaptor 238, second adaptor 238*a* includes auger mounting channel 1608 and a second disk portion 1610*a*. Similar to disk portion 1610, second disk portion 1610*a* includes mounting disk 2000, first disk 2002, second disk 2004, and second mounting channel 2006. Unlike disk portion 1610, a body portion 2400 of second disk portion 1610*a* does not extend flush with second disk 2004. As a result, less material may be used in forming second adaptor 238*a* than in forming adaptor 238.

Again, hook 1600 is mounted to mounting disk 2000. The first radius of mounting disk 2000 is less than the second radius of first disk 2002, and the first radius of mounting disk 2000 is less than the third radius of second disk 2004. The groove is formed when mounting disk 2000 is mounted between first disk 2002 and second disk 2004. Hook 1600 is configured to fit in the groove formed between first disk 200 and second disk 2004. Direction 1108 defines the longitudinal axis of auger mounting channel 1608. Second mounting channel 2006 extends at the angle from auger mounting channel 1608 that generally corresponds to the angle defined between first section 1100 of shaft 235 and transition section 1106 of auger 230 so that adaptor 238 can be positioned to abut transition section 1106 of auger 230 though this is not required. Center axis 2100 of mounting disk 2000, first disk 2002, and second disk 2004 of second disk portion 1610*a* extends in the direction parallel to and offset from direction 1108 defined through the center of shaft 235 of auger 230 when shaft 235 is positioned within auger mounting channel 1608. Of course, second adaptor 238*a* may be formed of a single piece of material, for example, by molding.

In the illustrative embodiment of FIGS. 24 and 25, auger mounting channel 1608 is a trough formed in the circumferential edge of mounting disk 2000, first disk 2002, and second disk 2004 of second disk portion 1610*a* such that second disk portion 1610*a* forms a c-shape when second adaptor 238*a* is viewed along the longitudinal axis of auger mounting channel 1608. When shaft 235 of auger 230 rotates, center axis 2100 rotates about shaft 235 of auger 230 positioned in auger mounting channel 1608. As a result, hook 1600, which is mounted to mounting disk 2000, translates in a translation direction perpendicular to direction 1108 to break up any ice that has become stuck together in ice receptacle 201. Though there may be incidental rotation of hook 1600 with second adaptor 238*a*, the primary motion is in the translation direction when second adaptor 238*a* rotates with shaft 235 of auger 230.

Figure 26:
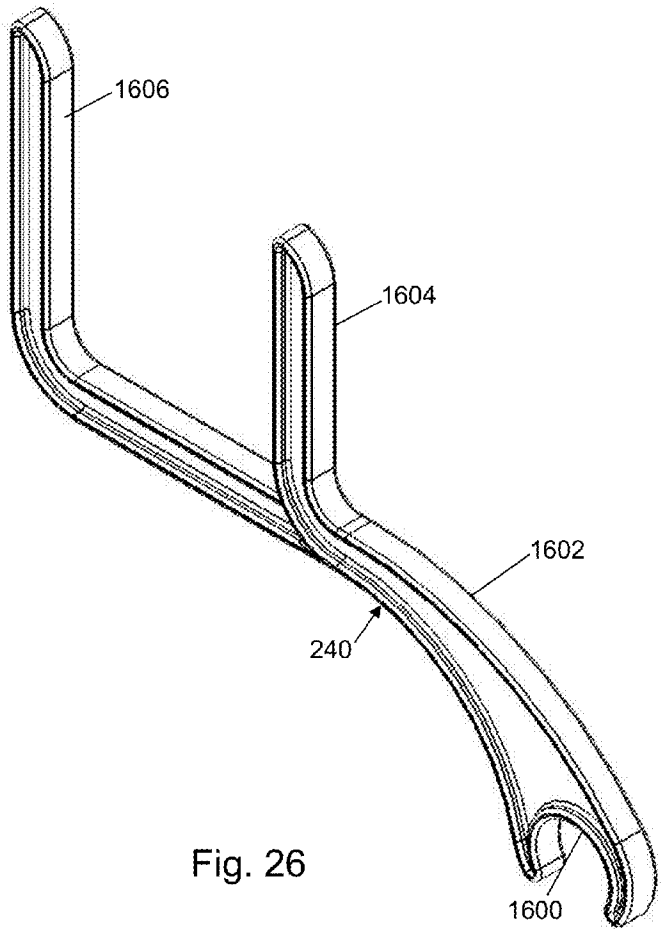
FIG. 26 depicts a front perspective view of the ice agitator of FIG. 16 in accordance with a first illustrative embodiment.

With reference to FIG. 26, a front perspective view of ice agitator 240 is shown in accordance with an illustrative embodiment. Hook 1600 forms a semicircle that fits within the groove formed between first disk 2002 and second disk 2004. Hook 1600 further at least partially surrounds mounting disk 2000. The semicircle of hook 1600 is sized and shaped to surround mounting disk 2000 sufficiently such that hook 1600 remains mounted in the groove formed in disk portion 1610 or in second disk portion 1610*a* as auger 230 rotates even when arm 1602 encounters ice that exerts a counter force on arm 1602. Arm 1602 is formed from a material such that arm 1602 has sufficient rigidity to withstand the counter force on arm 1602. A length of arm 1602 is selected such that arm 1602 extends along bottom wall 210 of ice receptacle 201 to within approximately an ice cube width of left side wall 204 as shown with reference to the illustrative embodiment of FIGS. 3 and 4.

Figure 27:
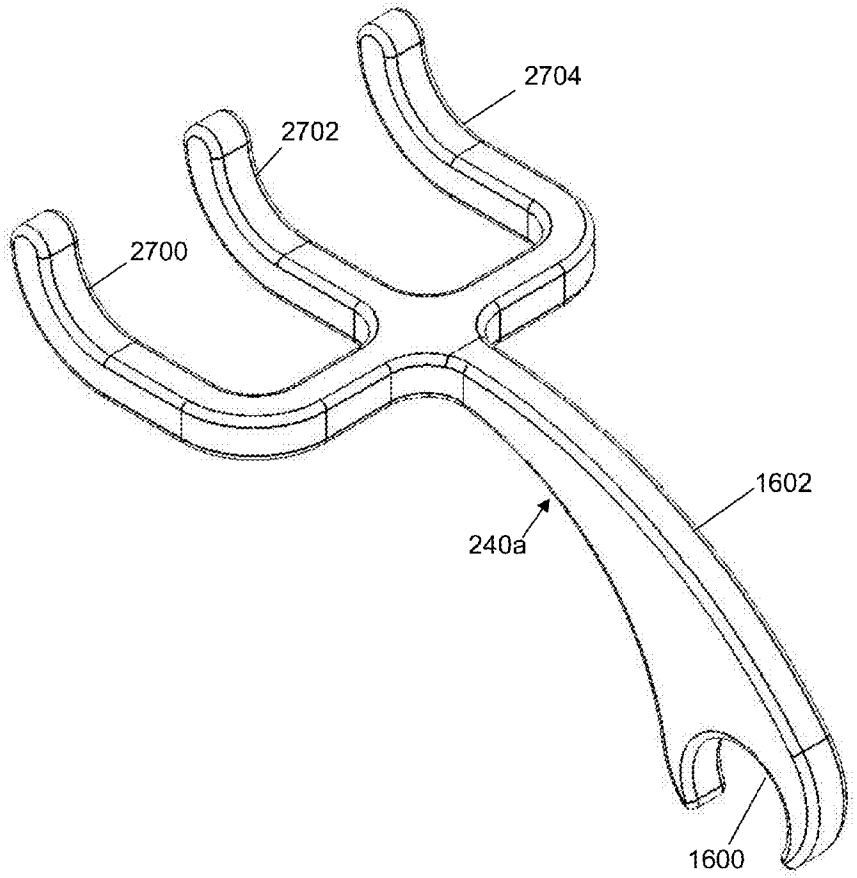
FIG. 27 depicts a front perspective view of a second ice agitator in accordance with a second illustrative embodiment.
Figure 28:
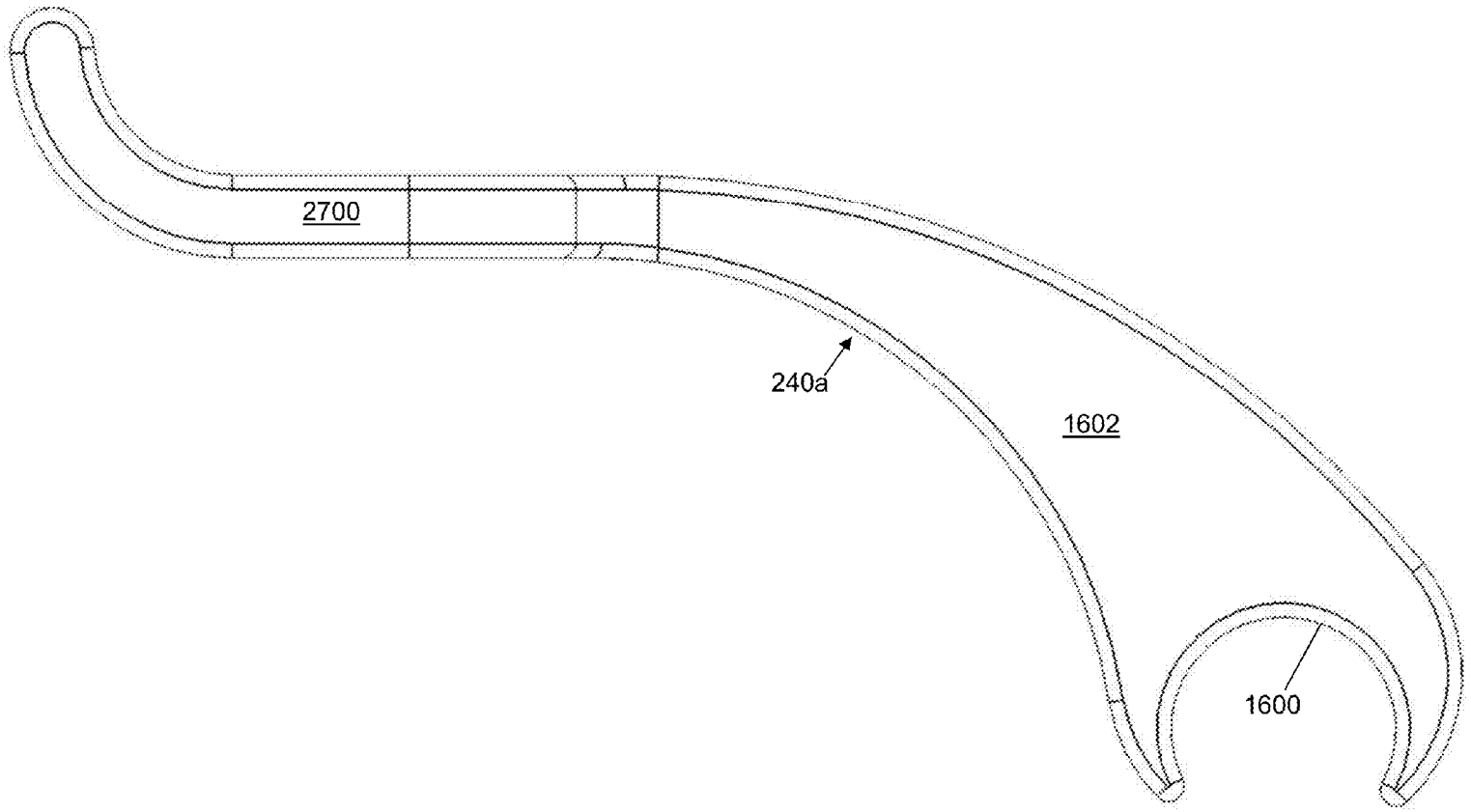
FIG. 28 depicts a front view of the second ice agitator of FIG. 27 in accordance with a first illustrative embodiment.
Figure 29:
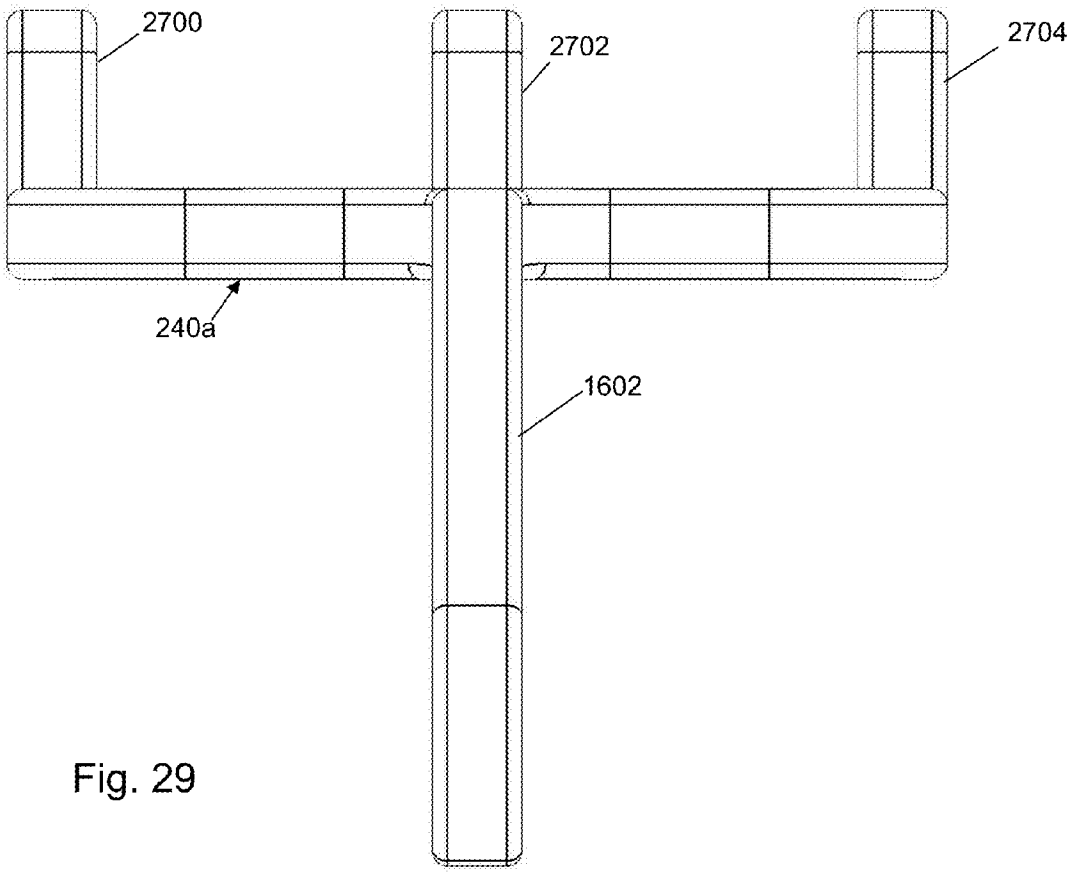
FIG. 29 depicts a side view of the second ice agitator of FIG. 27 in accordance with a first illustrative embodiment.

With reference to FIG. 27, a front perspective view of a second ice agitator 240*a* is shown in accordance with a second illustrative embodiment. With reference to FIG. 28, a front view of second ice agitator 240*a* is shown in accordance with the second illustrative embodiment. With reference to FIG. 29, a side view of second ice agitator 240*a* is shown in accordance with the second illustrative embodiment. Second ice agitator 240*a* includes hook 1600, arm 1602, a first finger 2700, a second finger 2702, and a third finger 2704. First finger 2700, second finger 2702, and third finger 2704 extend from arm 1602 at an end of arm 1602 opposite hook 1600. First finger 2700, second finger 2702, and third finger 2704 are distributed along arm 1602 to extend up from arm 1602 at the same radial distance from shaft 235 of auger 230. Arm 1602 is curved upward from hook 1600 when hook 1600 is mounted to disk portion 1610 or second disk portion 1610*a*.

Figure 30:
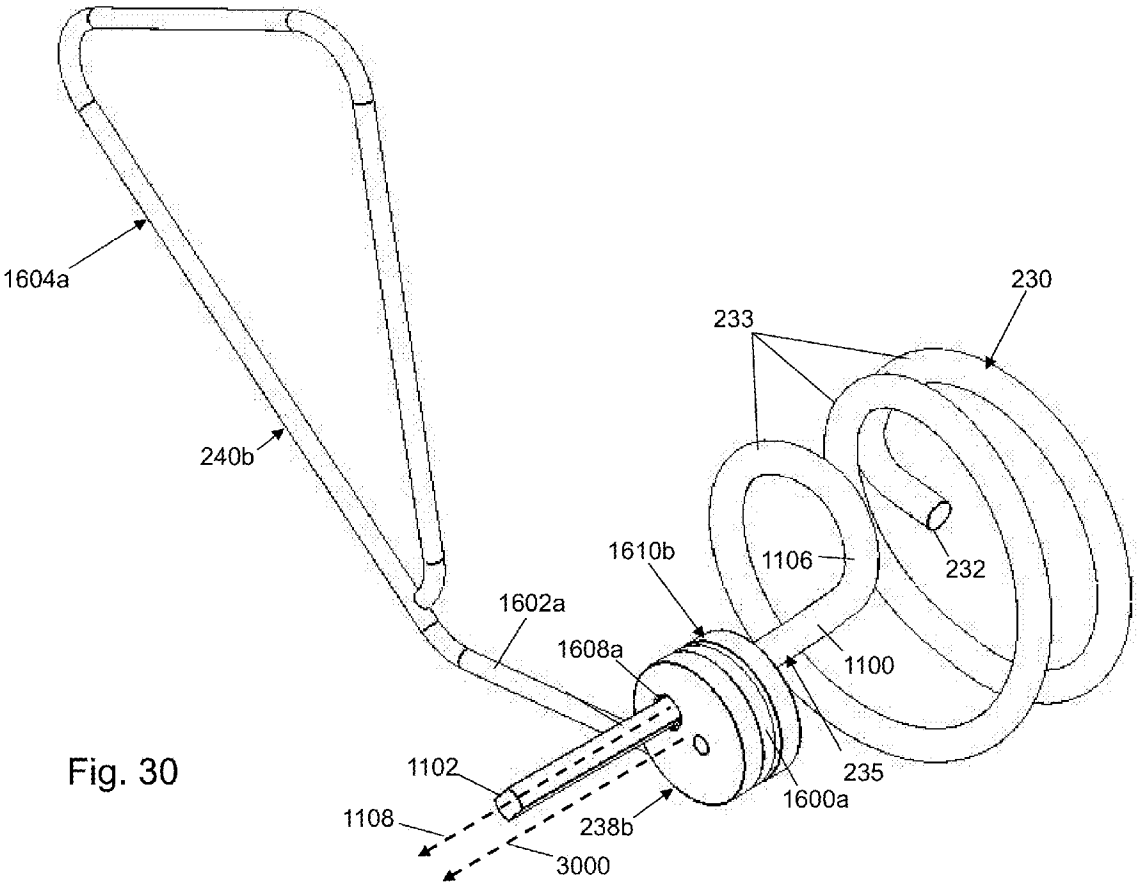
FIG. 30 depicts a front perspective view of a third adaptor, a third ice agitator, and the auger of a second auger system in accordance with an illustrative embodiment.
Figure 31:
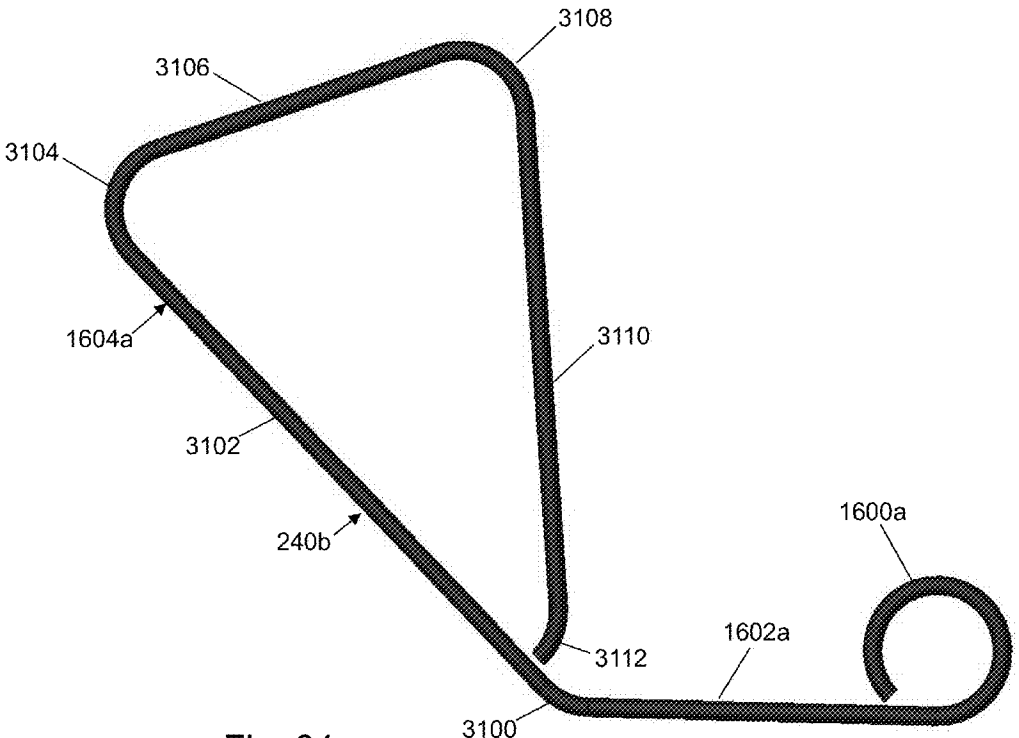
FIG. 31 depicts a front view of the third ice agitator of FIG. 30 in accordance with a third illustrative embodiment.
Figure 32:
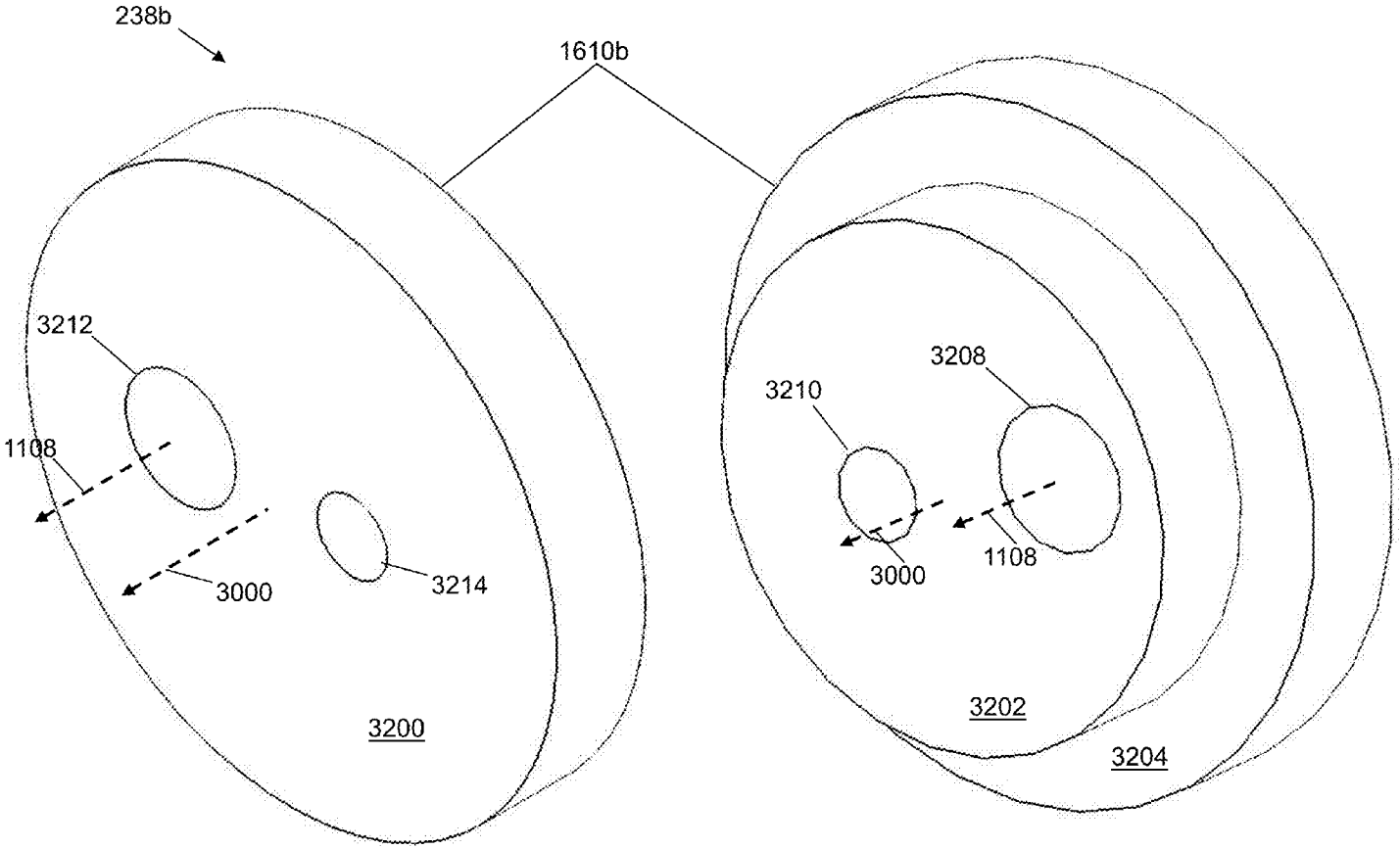
FIG. 32 depicts a front perspective view of the third adaptor of FIG. 30 in accordance with a third illustrative embodiment.

With reference to FIG. 30, a top, front perspective view of a third adaptor 238*b*, a third ice agitator 240*b*, and auger 230 is shown in accordance with a third illustrative embodiment. With reference to FIG. 31, a front view of third ice agitator 240*b* of FIG. 30 is shown in accordance with a third illustrative embodiment. With reference to FIG. 32, a front perspective view of third adaptor 238*b* of FIG. 30 is shown in accordance with a third illustrative embodiment.

Third ice agitator 240*b* includes a second hook 1600*a* and a second arm 1602*a* that extends from second hook 1600*a* away from direction 1108, the axis of rotation of shaft 235.

Second hook 1600*a* forms a partially closed loop that extends partially around a third disk portion 1610*b* of third adaptor 238*b* to mount second hook 1600*a* to third adaptor 238*b*. In alternative embodiments, hook 1600, second hook 1600*a*, and/or third hook 1600*b* may form a closed loop. Third ice agitator 240*b* further includes a finger 1604*a* that extends from second arm 1602*a* at an end of second arm 1602*a* opposite second hook 1600*a*. Second arm 1602*a* extends from below second hook 1600*a* when second hook 1600*a* is mounted to third adaptor 238*b*.

As shown with reference to FIG. 31, finger 1604*a* may include a first corner 3100, a first branch 3102, a second corner 3104, a second branch 3106, a third corner 3108, a third branch 3110, and a fourth corner 3112. First corner 3100 mounts second arm 1602*a* to first branch 3102 such that first branch 3102 generally parallels a sloped portion of bottom wall 210 of ice receptacle 201. Second corner 3104 mounts first branch 3102 to second branch 3106. Third corner 3108 mounts second branch 3106 to third branch 3110. Fourth corner 3112 extends finger 1604*a* back towards first branch 3102 to form a generally triangular shape.

Finger 1604*a* has a generally triangular shape defined by first branch 3102, second corner 3104, second branch 3106, third corner 3108, third branch 3110, and fourth corner 3112, where first branch 3102, second branch 3106, and third branch 3110 form the sides of the triangle. The generally triangular shape may vary with different angles defined by second corner 3104, third corner 3108, and fourth corner 3112. For example, finger 1604*a* may form a right triangle with second corner 3104 forming an approximately 90 degree transition between first branch 3102 and second branch 3106. In another alternative embodiment, finger 1604*a* may form an isosceles triangle with second corner 3104 forming a first transition angle between first branch 3102 and second branch 3106 that is approximately equal to a second transition angle formed by fourth corner 3112. In still another alternative embodiment, finger 1604*a* may form a right triangle with fourth corner 3112 forming an approximately 90 degree transition between first branch 3102 and third branch 3110.

With reference to FIG. 32, third adaptor 238*b* may include third disk portion 1610*b* and a second auger mounting channel 1608*a*. Third disk portion 1610*b* includes a first disk 3200, a second disk 3202, and a third disk 3204. A first radius of second disk 3202 is less than a second radius of first disk 3200. The first radius of second disk 3202 is less than a third radius of third disk 3204. A groove is formed when second disk 3202 is mounted between first disk 3200 and third disk 3204. For example, second disk 3202 may be molded to or otherwise mounted to third disk 3204. A first portion 3208 of second auger mounting channel 1608*a* extends through second disk 3202 and third disk 3204. A first portion 3210 of a disk mounting orifice also extends through second disk 3202 and third disk 3204. A second portion 3212 of second auger mounting channel 1608*a* extends through first disk 3200. A second portion 3214 of the disk mounting orifice also extends through first disk 3200. The disk mounting orifice is sized and shaped to accept a fastener. Second disk 3202 may be mounted between first disk 3200 and third disk 3204 by mounting between first disk 3200 to second disk 3202. First disk 3200 is positioned adjacent second disk 3202 with both first portion 3208 and second portion 3212 of second auger mounting channel 1608*a* in alignment and first portion 3210 and second portion 3214 of the disk mounting orifice in alignment. The fastener is inserted into the disk mounting orifice.

A portion of shaft 235 is positioned to fit within second auger mounting channel 1608*a* such that third adaptor 238*b* rotates with shaft 235 of auger 230. For example, first section 1100, second section 1102, and/or a portion of shaft transition section 1104 may fit within second auger mounting channel 1608*a*. Second auger mounting channel 1608*a* is an orifice that extends through third disk portion 1610*b* in a direction that is parallel to direction 1108. Second auger mounting channel 1608*a* is further offset from an axis of rotation defined through a center axis 3000 (shown with reference to FIGS. 30 and 32) of third disk portion 1610*b*. Center axis 3000 extends through first disk 3200, second disk 3202, and third disk 3204 of third disk portion 1610*b* in a direction parallel to and offset from direction 1108 defined through the center of shaft 235 of auger 230 when shaft 235 is positioned within second auger mounting channel 1608*a*. For example, center axis 3000 is a center of a circle circumscribed about a peripheral edge of second disk 3202.

When shaft 235 of auger 230 rotates, center axis 3000 rotates about shaft 235 of auger 230 positioned in second auger mounting channel 1608*a*. As a result, second hook 1600*a*, which is mounted to second disk 3202, translates in a translation direction perpendicular to direction 1108 to break up any ice that has become stuck together in ice receptacle 201. Though there may be incidental rotation of second hook 1600*a* with third adaptor 238*b*, the primary motion is in the translation direction when third adaptor 238*b* rotates with shaft 235 of auger 230.

Second hook 1600*a* is mounted to at least partially encircle second disk 3202. As a result, second hook 1600*a* fits within the groove formed between first disk 3200 and third disk 3204 of third disk portion 1610*b*. The semicircle of second hook 1600*a* is sized and shaped to sufficiently surround second disk 3202 such that second hook 1600*a* remains mounted in the groove as auger 230 rotates even when second arm 1602*a* encounters ice that exerts a counter force on second arm 1602*a*. Second arm 1602*a* is formed from a material having sufficient rigidity to withstand the counter force on second arm 1602*a*.

Figure 34:
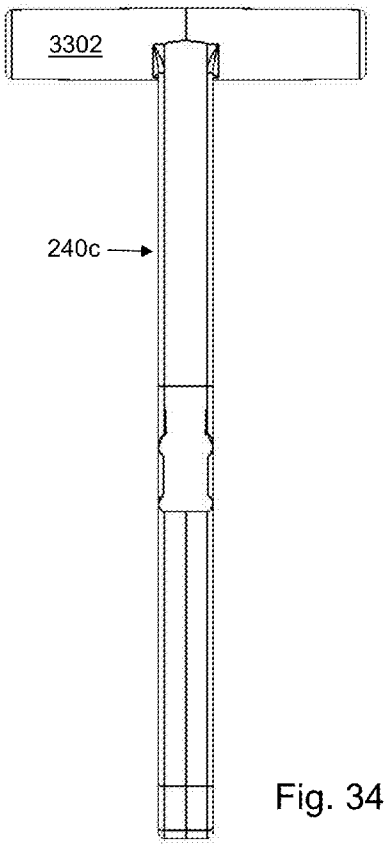
FIG. 34 depicts a side view of the fourth ice agitator of FIG. 33 in accordance with a fourth illustrative embodiment.
Figure 33:
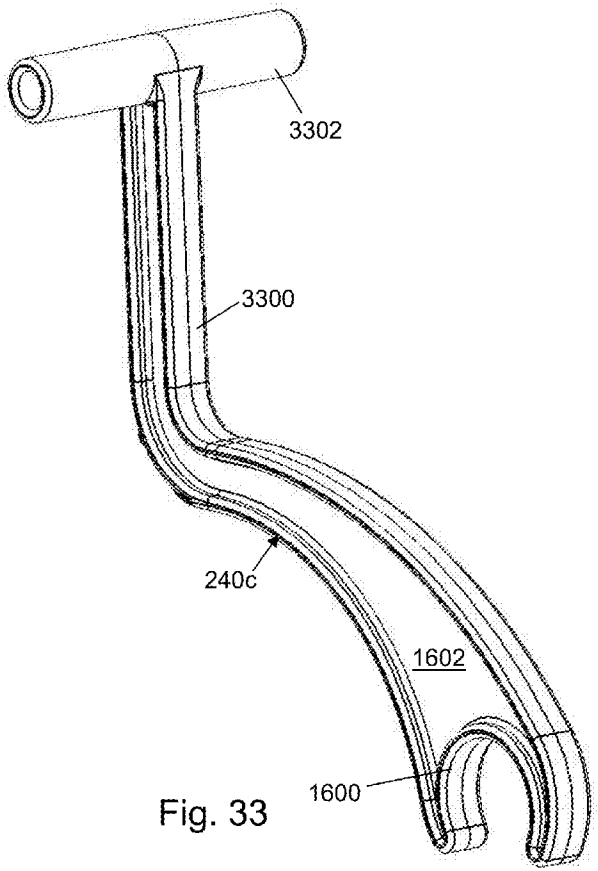
FIG. 33 depicts a front perspective view of a fourth ice agitator in accordance with a fourth illustrative embodiment.
Figure 35:
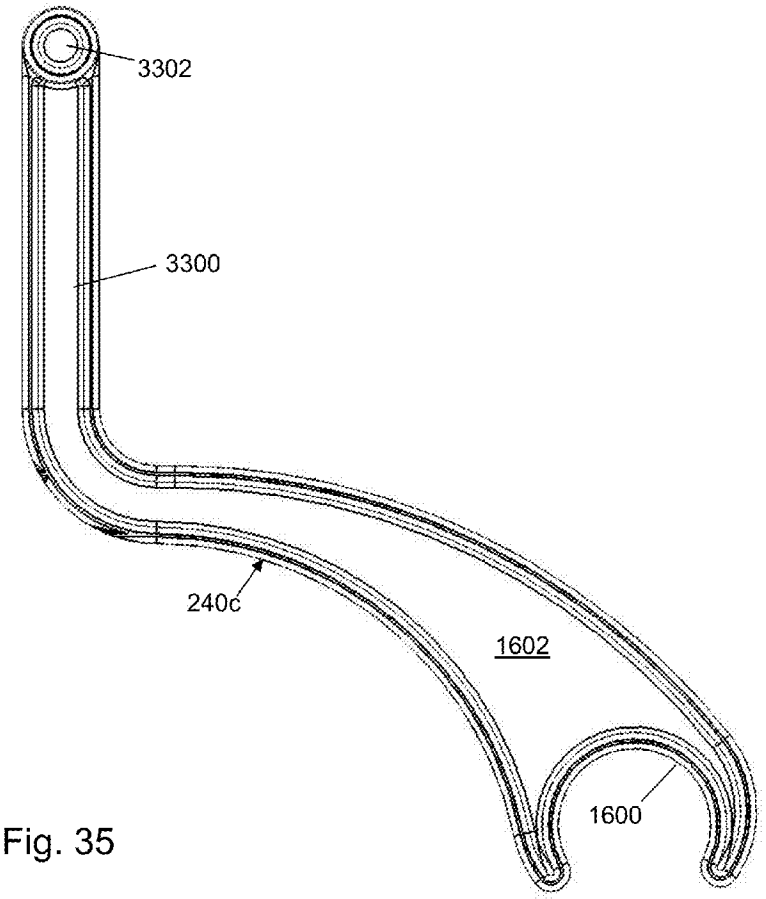
FIG. 35 depicts a front view of the fourth ice agitator of FIG. 33 in accordance with a fourth illustrative embodiment.

With reference to FIG. 33, a front perspective view of a fourth ice agitator 240*c* is shown in accordance with a fourth illustrative embodiment. With reference to FIG. 34, a side view of fourth ice agitator 240*c* is shown in accordance with the fourth illustrative embodiment. With reference to FIG. 35, a front view of fourth ice agitator 240*c* is shown in accordance with the fourth illustrative embodiment. Fourth ice agitator 240*c* includes hook 1600, arm 1602, a first finger 3300, and a head 3302. First finger 3300 extends from arm 1602 at an end of arm 1602 opposite hook 1600. First finger 3300 extends up from arm 1602 at approximately 90 degrees. Arm 1602 is curved upward from hook 1600 when hook 1600 is mounted to disk portion 1610 or second disk portion 1610*a*. Head 3302 is mounted to an end of first finger 3300 opposite arm 1602 to form a "T" shape that extends from arm 1602. In the illustrative embodiment of FIGS. 33-35, head 3302 has a cylindrical shaped body though other shaped bodies may be used including square, rectangular, elliptical, triangular, and other polygonal shapes. Though in the illustrative embodiment of FIGS. 33-35, head 3302 form the "T" shape, head 3302 further may form an inverted a "L" shape that extends from arm 1602.

Figure 36:
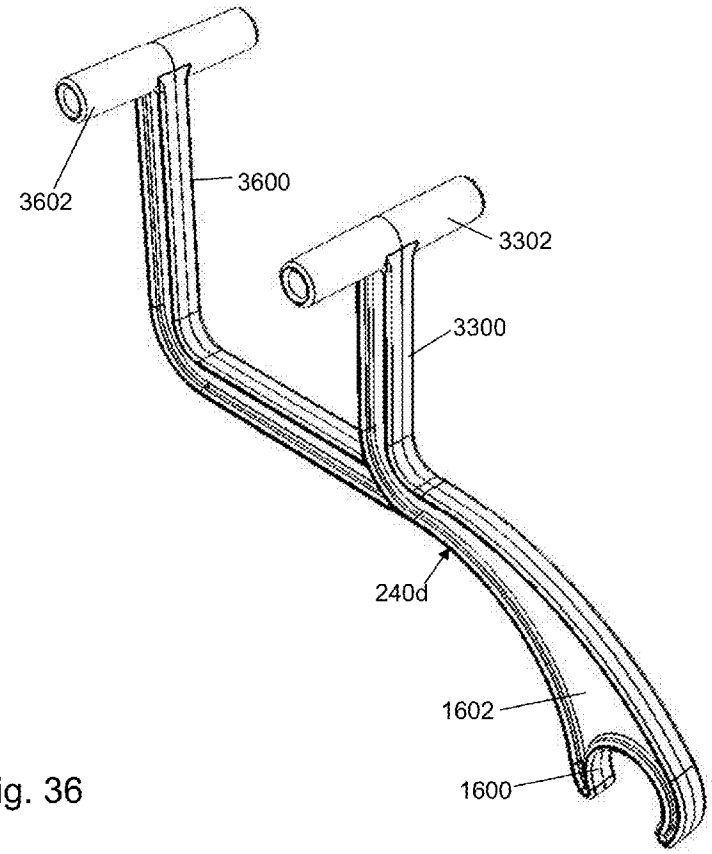
FIG. 36 depicts a front perspective view of a fifth ice agitator in accordance with a fifth illustrative embodiment.
Figure 37:
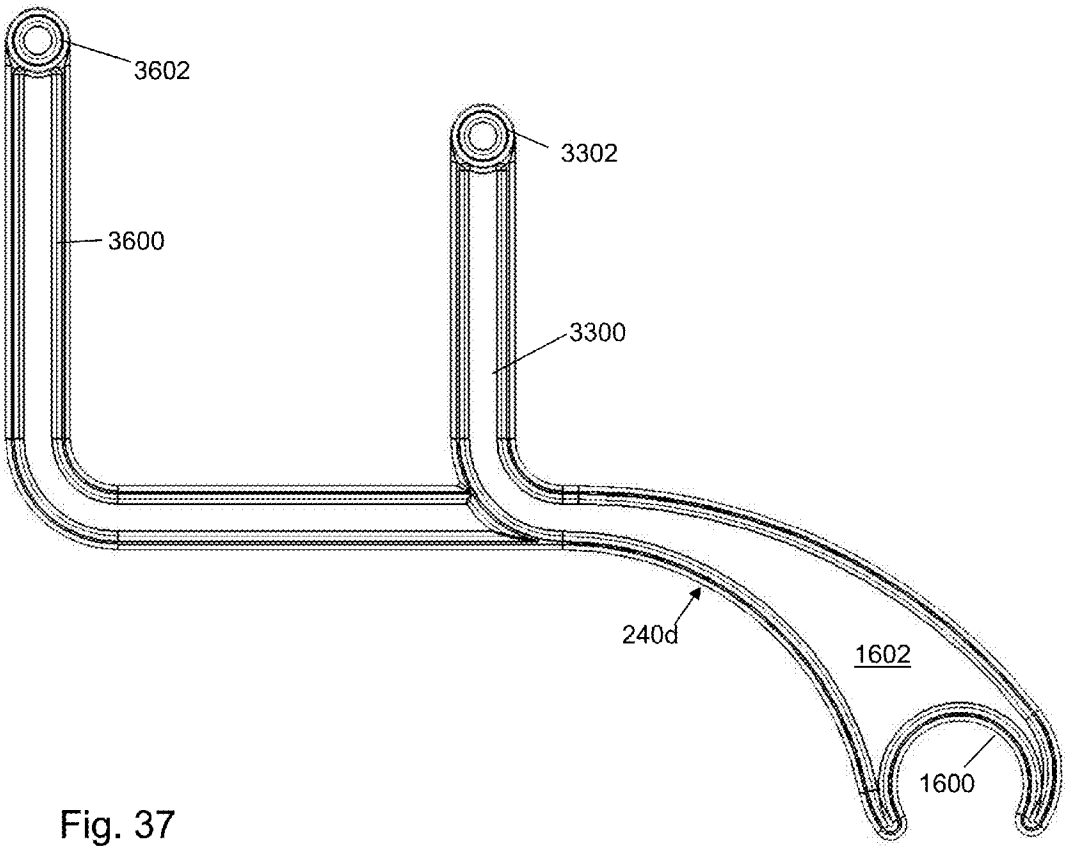
FIG. 37 depicts a front view of the fifth ice agitator of FIG. 36 in accordance with a fifth illustrative embodiment.

With reference to FIG. 36, a front perspective view of a fifth ice agitator 240*d* is shown in accordance with a fifth illustrative embodiment. With reference to FIG. 37, a front view of fifth ice agitator 240*d* is shown in accordance with the fifth illustrative embodiment. Fifth ice agitator 240*d* includes hook 1600, arm 1602, first finger 3300, head 3302, a second finger 3600, and a second head 3602. Similar to first finger 3300, second finger 3600 extends from arm 1602 at an end of arm 1602 opposite hook 1600. Second finger 3600 extends up from arm 1602 at approximately 90 degrees. Arm 1602 is curved upward from hook 1600 when hook 1600 is mounted to disk portion 1610 or second disk portion 1610*a*. Second head 3602 is mounted to an end of second finger 3600 opposite arm 1602 to form a "T" shape that extends from arm 1602. In the illustrative embodiment of FIGS. 36-37, second head 3602 has a cylindrical shaped body though other shaped bodies may be used including square, rectangular, elliptical, triangular, and other polygonal shapes. Though in the illustrative embodiment of FIGS. 36-37, second head 3602 forms the "T" shape, second head 3602 further may form an inverted a "L" shape that extends from arm 1602. Second head 3602 and head 3302 may have the same or different shapes and sizes.

Figure 38:
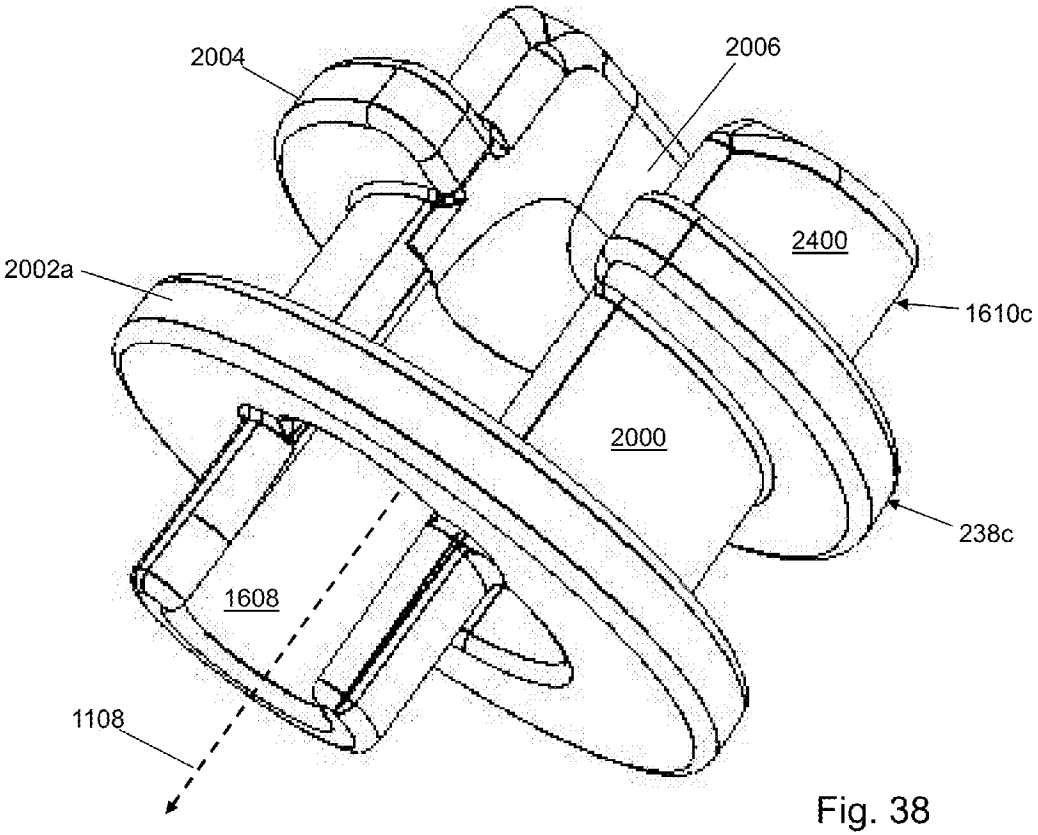
FIG. 38 depicts a top perspective view of a fourth adaptor in accordance with a fourth illustrative embodiment.
Figure 40:
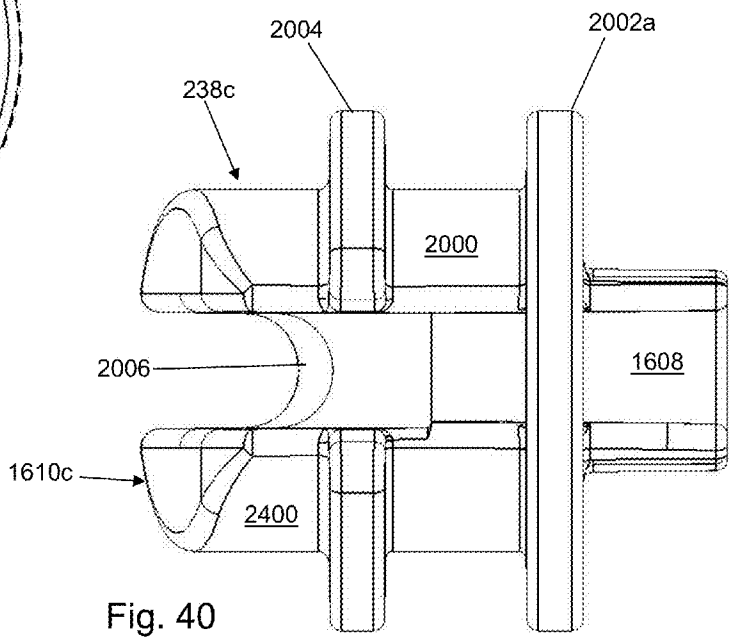
FIG. 40 depicts a top view of the fourth adaptor of FIG. 38 in accordance with a fourth illustrative embodiment.
Figure 39:
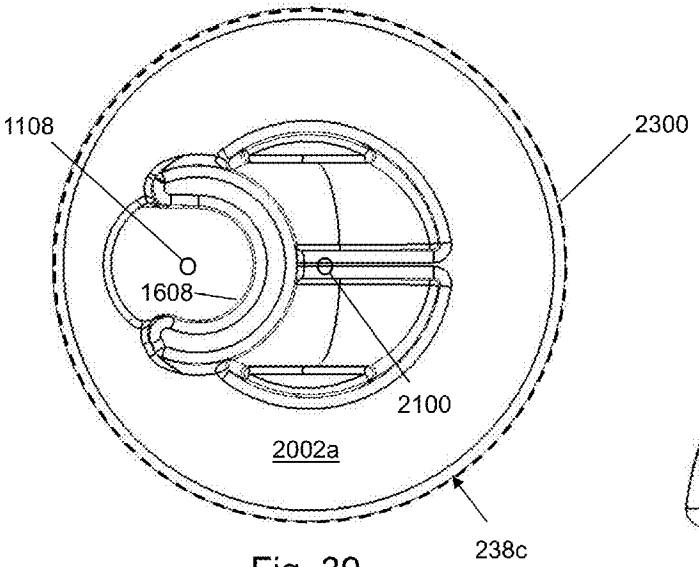
FIG. 39 depicts a front view of the fourth adaptor of FIG. 38 in accordance with a fourth illustrative embodiment.

With reference to FIG. 38, a top perspective view of a fourth adaptor 238*c* is shown in accordance with a fourth illustrative embodiment. With reference to FIG. 39, a front view of fourth adaptor 238*c* is shown in accordance with the fourth illustrative embodiment. With reference to FIG. 39, fourth adaptor 238*c* is viewed with direction 1108 coming out of the page along a longitudinal axis of auger mounting channel 1608. With reference to FIG. 40, a top view of fourth adaptor 238*c* is shown in accordance with the fourth illustrative embodiment. Similar to adaptor 238, fourth adaptor 238*c* includes auger mounting channel 1608 and a fourth disk portion 1610*c*. Fourth disk portion 1610*c* includes mounting disk 2000, a ring 2002*a*, second disk 2004, second mounting channel 2006, and body portion 2400. Of course, ring 2002*a* may also be referenced generally as a disk. Unlike first disk 2002, ring 2002*a* of fourth disk portion 1610*c* encircles auger mounting channel 1608. As a result, ring 2002*a* of fourth disk portion 1610*c* provides additional structure to hold shaft 235 within auger mounting channel 1608. Thus, fourth adaptor 238*c* is mounted to shaft 235 with more than the pressure or frictional fit provided by the shape of auger mounting channel 1608.

Again, hook 1600 is mounted to mounting disk 2000. The first radius of mounting disk 2000 is less than a second radius of ring 2002*a*, and the first radius of mounting disk 2000 is less than the third radius of second disk 2004. The groove is formed when mounting disk 2000 is mounted between ring 2002*a* and second disk 2004. Hook 1600 is configured to fit in the groove formed between ring 2002*a* and second disk 2004. Direction 1108 defines the longitudinal axis of auger mounting channel 1608. Second mounting channel 2006 extends at the angle from auger mounting channel 1608 that generally corresponds to the angle defined between first section 1100 of shaft 235 and transition section 1106 of auger 230 so that adaptor 238 can be positioned to abut transition section 1106 of auger 230 though this is not required. Center axis 2100 of mounting disk 2000, ring 2002*a*, and second disk 2004 of fourth disk portion 1610*c* extends in the direction parallel to and offset from direction 1108 defined through the center of shaft 235 of auger 230 when shaft 235 is positioned within auger mounting channel 1608. Center axis 2100 of fourth disk portion 1610*c* is a center of circle 2300 circumscribed about a peripheral edge of ring 2002*a*, which is also a center of a second circle (not shown) circumscribed about a peripheral edge of mounting disk 2000. Of course, fourth adaptor 238*c* may be formed of a single piece of material, for example, by molding.

In the illustrative embodiment of FIGS. 38-40, auger mounting channel 1608 is a trough formed in the circumferential edge of mounting disk 2000, ring 2002*a*, and second disk 2004 of fourth disk portion 1610*c* as discussed previously with reference to adaptor 238 and second adaptor 238*a*. However, because ring 2002*a* encircles auger mounting channel 1608, fourth disk portion 1610*c* forms an o-shape when viewed along the longitudinal axis of auger mounting channel 1608 as shown with reference to FIG. 39. When shaft 235 of auger 230 rotates, center axis 2100 rotates about shaft 235 of auger 230 positioned in auger mounting channel 1608. As a result, hook 1600, which is mounted to mounting disk 2000, translates in a translation direction perpendicular to direction 1108 to break up any ice that has become stuck together in ice receptacle 201. Though there may be incidental rotation of hook 1600 with fourth adaptor 238*c*, the primary motion is in the translation direction when fourth adaptor 238*c* rotates with shaft 235 of auger 230.

Figure 41:
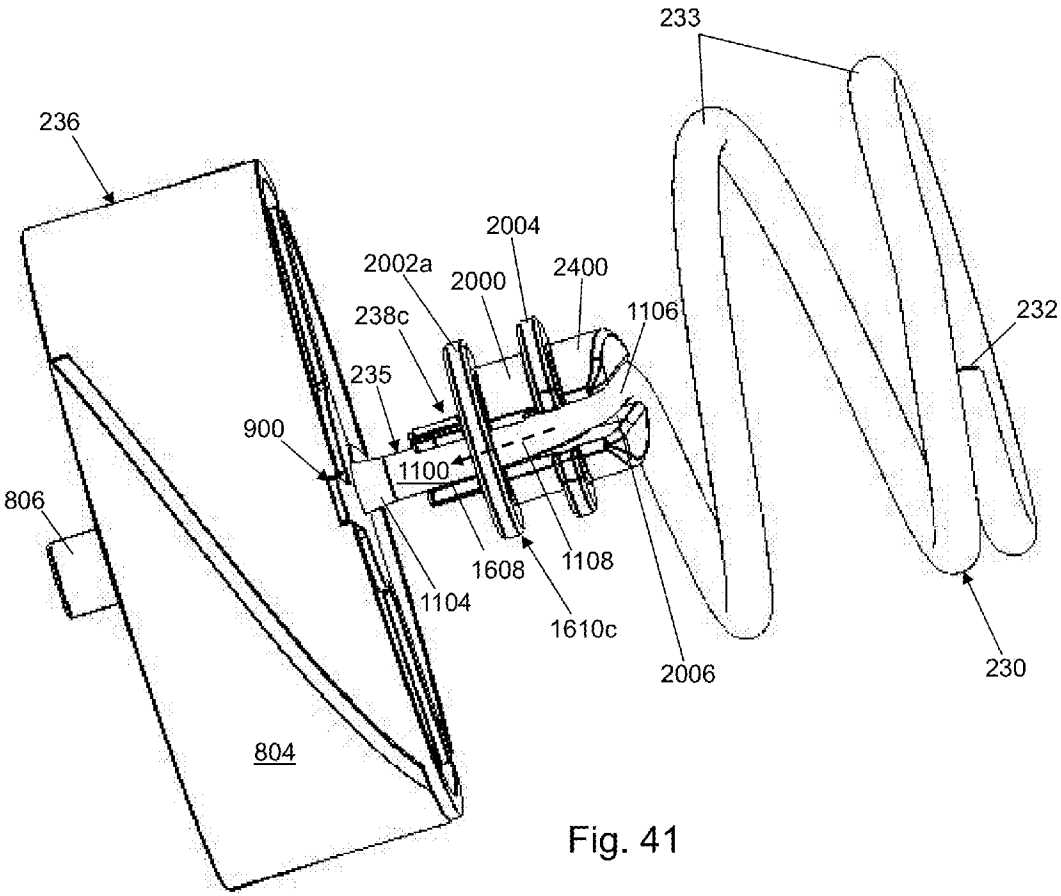
FIG. 41 depicts a right perspective view of the fourth adaptor of FIG. 38, the wheel of FIG. 13, and the auger of FIG. 11 in accordance with an illustrative embodiment.
Figure 42:
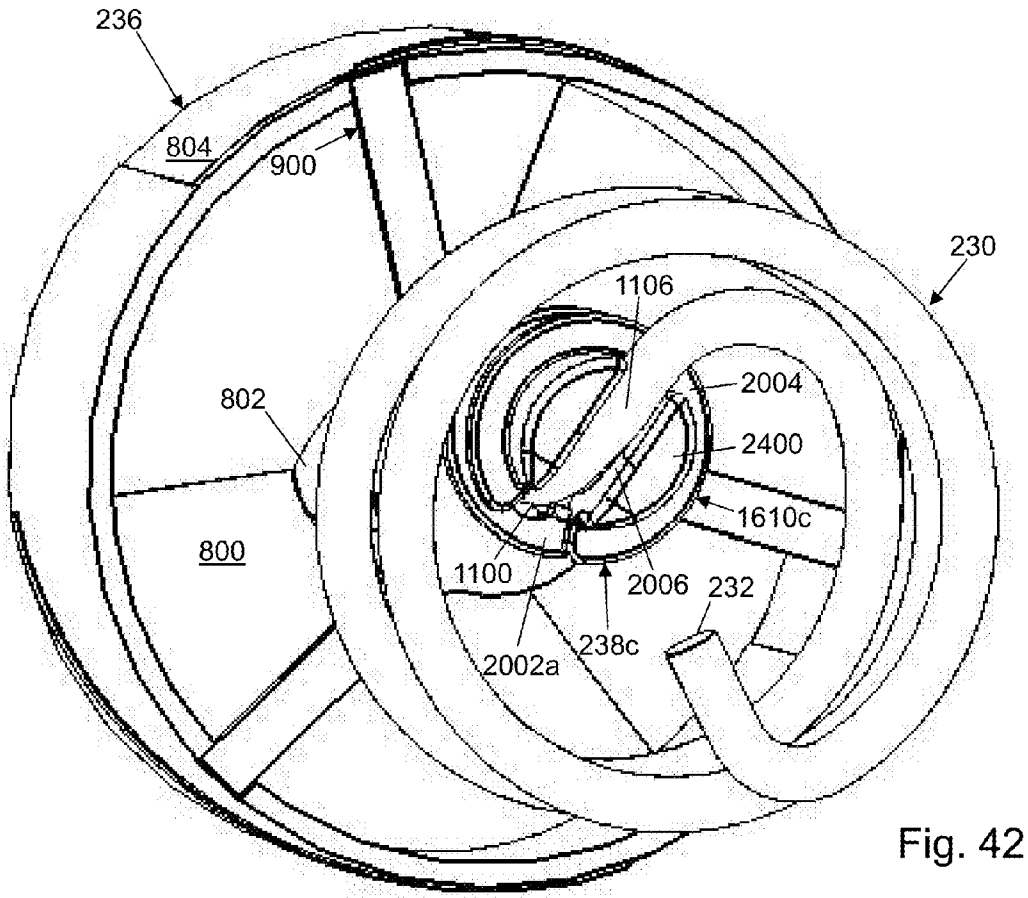
FIG. 42 depicts a back perspective view of the fourth adaptor of FIG. 38, the wheel of FIG. 13, and the auger of FIG. 11 in accordance with an illustrative embodiment.

FIG. 41 depicts a right perspective view of fourth adaptor 238*c* of FIG. 38, wheel 236 of FIG. 13, and auger 230 of FIG. 11 in accordance with an illustrative embodiment. With reference to FIG. 42, a back perspective view of fourth adaptor 238*c* of FIG. 38, wheel 236 of FIG. 13, and auger 230 of FIG. 11 is shown in accordance with an illustrative embodiment. Second mounting channel 2006 extends at an angle from auger mounting channel 1608 such that transition section 1106 of auger 230 can be positioned to abut second mounting channel 2006 while first section 1100 of auger 230 is positioned to abut auger mounting channel 1608. Thus, the angle between auger mounting channel 1608 and second mounting channel 2006 is approximately equal to that between transition section 1106 and first section 1100 of auger 230 so that adaptor 238, second adaptor 238*a*, and fourth adaptor 238*c* rotate with shaft 235 of auger 230.

Figure 43:
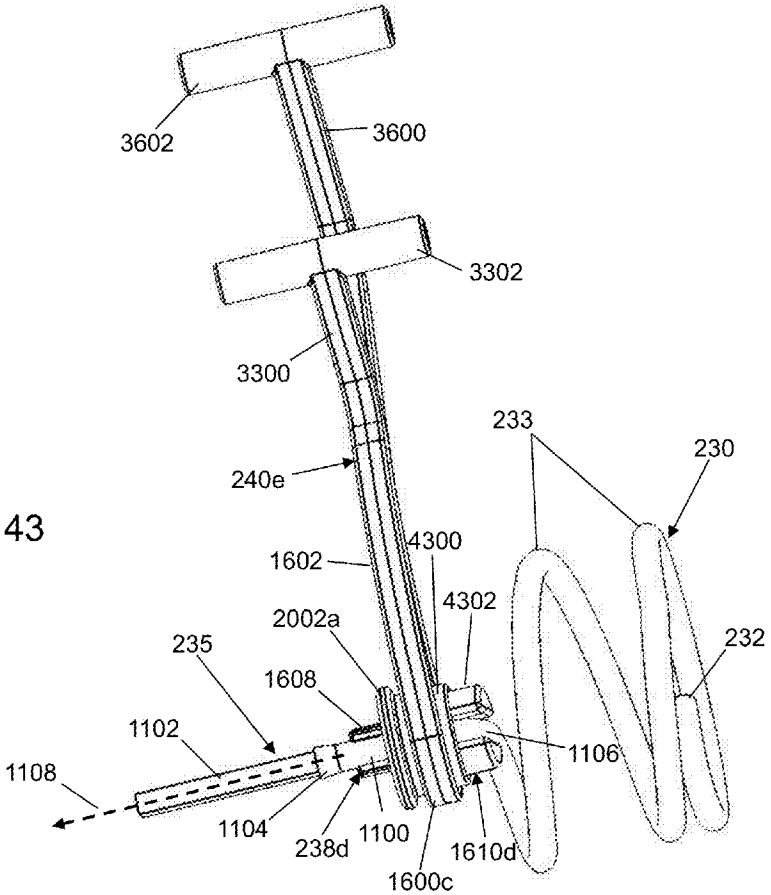
FIG. 43 depicts a top, right side perspective view of an adaptor in accordance with a fifth illustrative embodiment, an ice agitator in accordance with a sixth illustrative embodiment, and the auger of FIG. 11 in accordance with an illustrative embodiment.
Figure 44:
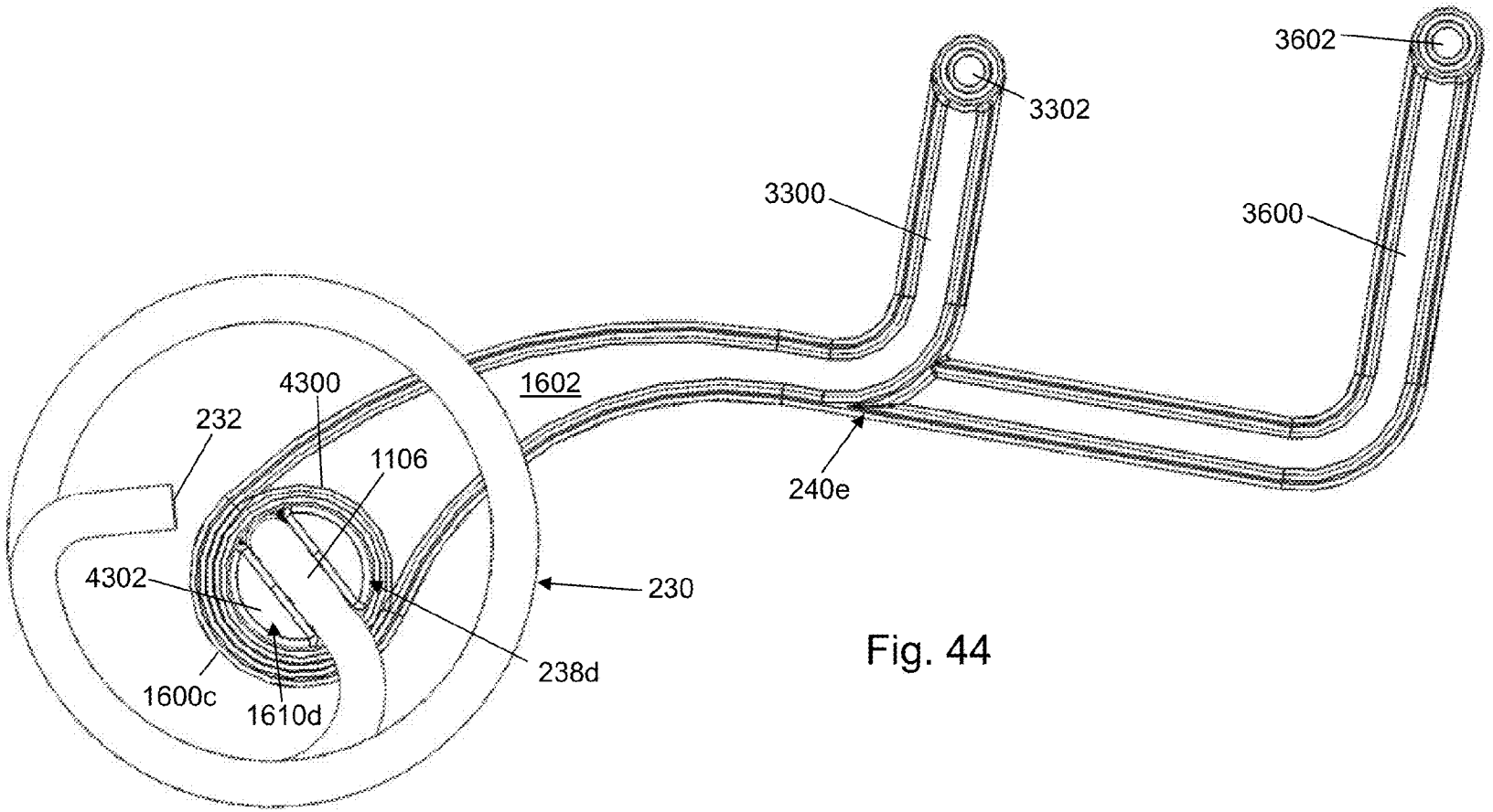
FIG. 44 depicts a back view of the adaptor, the ice agitator, and the auger of FIG. 43 in accordance with an illustrative embodiment.
Figure 45:
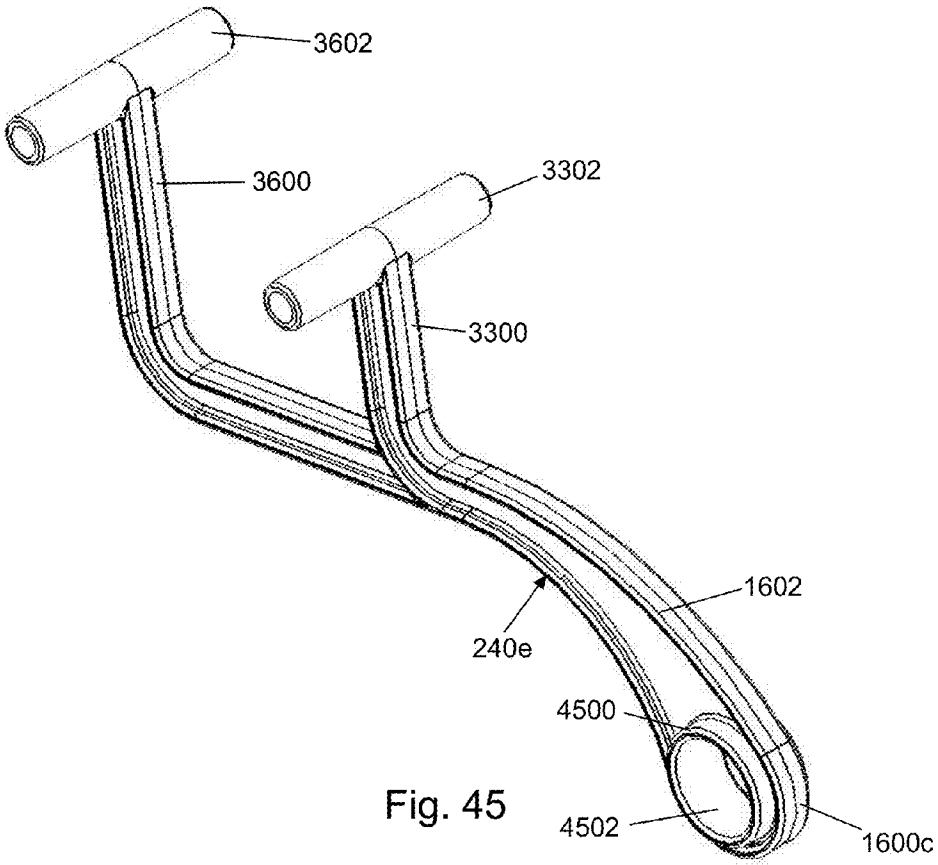
FIG. 45 depicts a front perspective view of the sixth ice agitator of FIG. 43 in accordance with a sixth illustrative embodiment.
Figure 46:
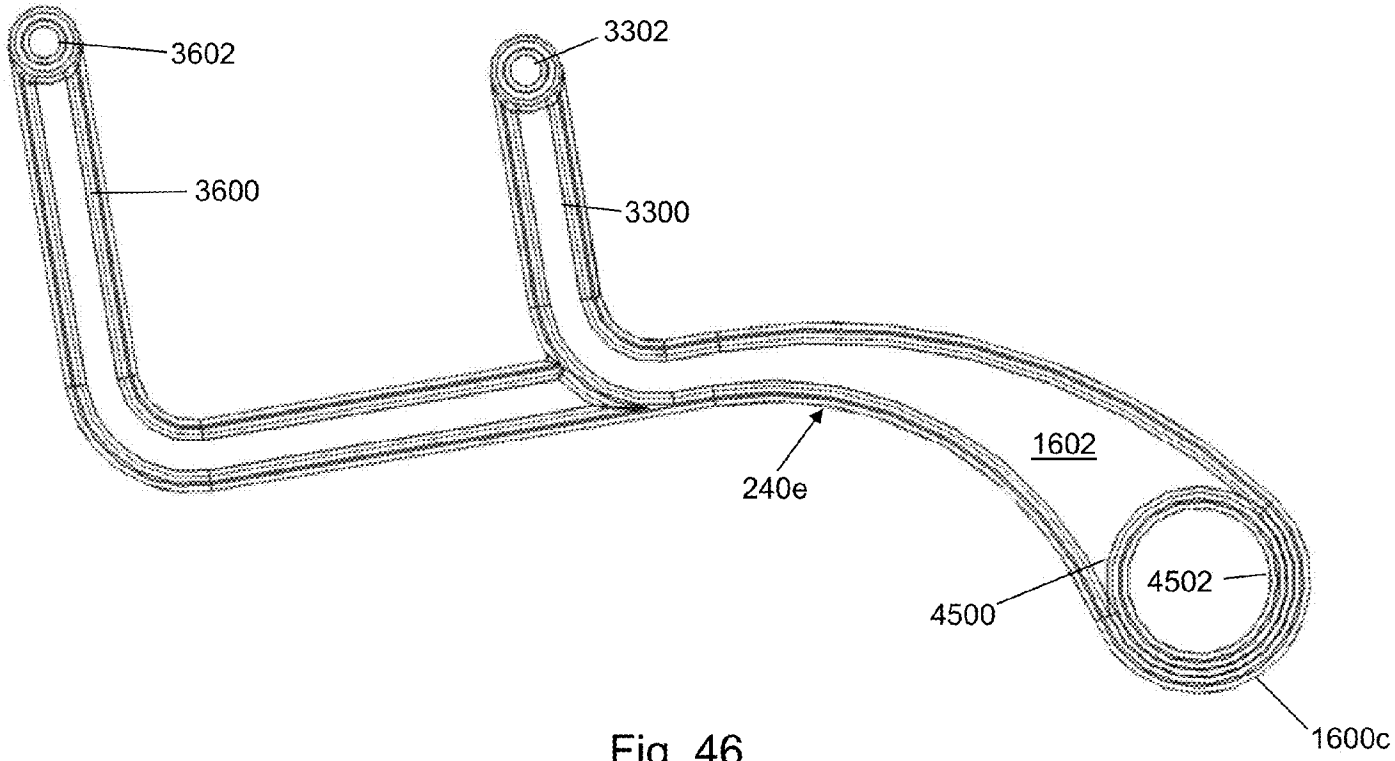
FIG. 46 depicts a front view of the sixth ice agitator of FIG. 43 in accordance with a sixth illustrative embodiment.
Figure 47:
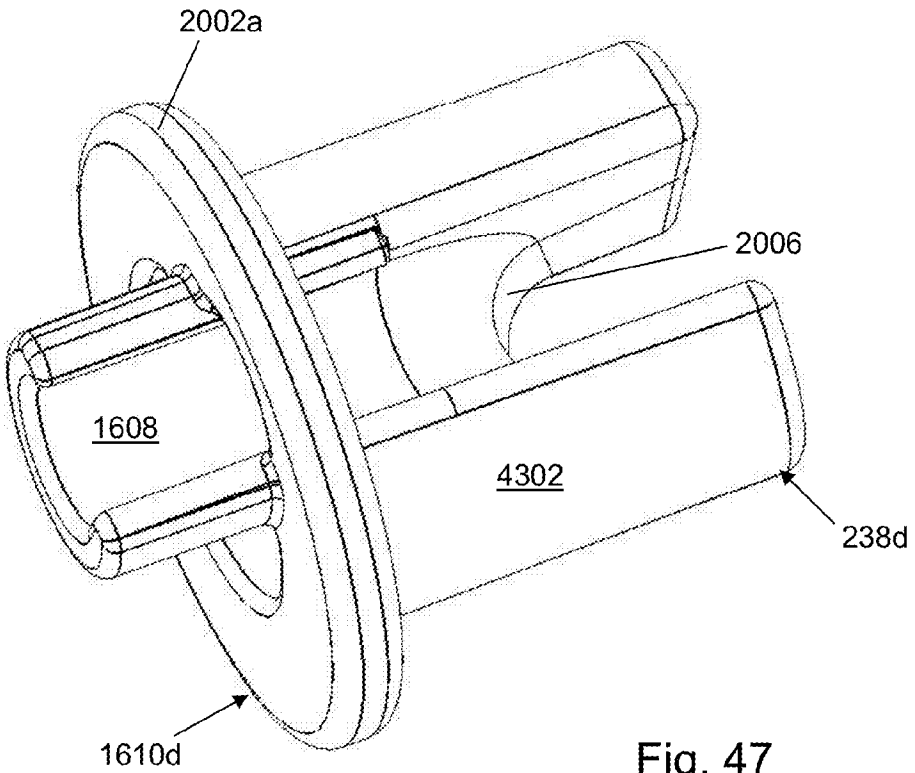
FIG. 47 depicts a top perspective view of the fifth adaptor of FIG. 43 in accordance with a fifth illustrative embodiment.

With reference to FIG. 43, a top, right side perspective view of a sixth ice agitator 240*e*, a fifth adaptor 238*d*, and auger 230 is shown in accordance with an illustrative embodiment. With reference to FIG. 44, a back view of sixth ice agitator 240*e*, a fifth adaptor 238*d*, and auger 230 is shown in accordance with an illustrative embodiment. Sixth ice agitator 240*e* is mounted to fifth adaptor 238*d*, and fifth adaptor 238*d* is mounted to shaft 235 of auger 230. With reference to FIG. 45, a front perspective view of sixth ice agitator 240*e* is shown in accordance with the sixth illustrative embodiment. With reference to FIG. 46, a front view of sixth ice agitator 240*e* is shown in accordance with the sixth illustrative embodiment. With reference to FIG. 47, a top perspective view of fifth adaptor 238*d* is shown in accordance with the fifth illustrative embodiment. Fifth adaptor 238*d* includes auger mounting channel 1608 and a fifth disk portion 1610*d*.

Sixth ice agitator 240*e* includes a fourth hook 1600*c* and arm 1602 that extends from fourth hook 1600*c* away from direction 1108, the axis of rotation of shaft 235. Fourth hook 1600*c* forms a closed loop that extends around a fifth disk portion 1610*d* of fifth adaptor 238*d* to mount fourth hook 1600*c* to fifth adaptor 238*d*. Similar to fifth ice agitator 240*d*, ice agitator 240*e* further includes first finger 3300, head 3302, second finger 3600, and second head 3602. Arm 1602 is curved upward from fourth hook 1600*c* when fourth hook 1600*c* is mounted to fifth disk portion 1610*d*. A first ring 4300 and a second ring 4500 (shown with reference to FIG. 45) extend from opposite faces of arm 1602 within the circumference of fourth hook 1600*c*. An inner surface of first ring 4300, of second ring 4500, and of fourth hook 1600*c* form a cylinder 4502, which encircles a portion of fifth disk portion 1610*d* of fifth adaptor 238*d* when sixth ice agitator 240*e* is mounted to fifth adaptor 238*d*. Thus, the radius of cylinder 4502 is greater than the radius of fifth disk portion 1610*d*.

Fifth disk portion 1610*d* includes ring 2002*a* and a body portion 4302. In the illustrative embodiment of FIG. 47, auger mounting channel 1608 is a trough formed in the circumferential edge of ring 2002*a* and of body portion 4302. A portion of shaft 235 is positioned to fit within auger mounting channel 1608 such that fifth adaptor 238*d* rotates with shaft 235 of auger 230. First section 1100 and/or a portion of shaft transition section 1104 may fit within auger mounting channel 1608. Auger mounting channel 1608 extends in a direction parallel to direction 1108, which defines the longitudinal axis of auger mounting channel 1608. Second mounting channel 2006 extends at the angle from auger mounting channel 1608 that generally corresponds to the angle defined between first section 1100 of shaft 235 and transition section 1106 of auger 230 so that transition section 1106 of auger 230 abuts second mounting channel 2006 so that fifth adaptor 238*d* remains mounted to auger 230 as fifth adaptor 238*d* rotates with shaft 235 of auger 230.

Center axis 2100 (not shown in FIG. 47) of ring 2002*a* of fifth disk portion 1610*d* extends in the direction parallel to and offset from direction 1108 defined through the center of shaft 235 of auger 230 when shaft 235 is positioned within auger mounting channel 1608 and transition section 1106 of auger 230 is positioned within second mounting channel 2006. As shown and discussed previously with reference to FIG. 21, center axis 2100 of fifth disk portion 1610*d* is a center of circle circumscribed about the peripheral edge of ring 2002*a*. When shaft 235 of auger 230 rotates, center axis 2100 rotates about shaft 235 of auger 230 positioned in auger mounting channel 1608. As a result, fourth hook 1600*c*, which is mounted to fifth disk portion 1610*d*, translates in a translation direction perpendicular to direction 1108 to break up any ice that has become stuck together in ice receptacle 201. Though there may be incidental rotation of fourth hook 1600*c* with fifth adaptor 238*d*, the primary motion is in the translation direction as fifth adaptor 238*d* rotates with shaft 235 of auger 230.

In alternative embodiments, various combinations of arms, hooks, fingers, and heads may be used to form an ice agitator. The dimensions may be selected based on the dimensions of ice receptacle 201 as understood by a person of skill in the art. Additional ice agitators may be mounted to shaft 235 to provide additional agitation of the ice cubes in the longitudinal direction along shaft 235 to further prevent the ice cubes from sticking together. Additional or fewer fingers may extend from arm 1602 and/or second arm 1602*a* to provide additional agitation of the ice cubes in the axial direction relative to shaft 235 to further prevent the ice cubes from sticking together. Additional or fewer heads may extend from the fingers of arm 1602 and/or second arm 1602*a* to provide additional agitation of the ice cubes. The components of the adaptors and ice agitators described herein may be formed of one or more discrete parts or may be formed of one or more molded parts.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. An ice agitation system comprising:

an adaptor comprising a disk portion and an auger mounting channel, wherein the auger mounting channel is configured to mount to a shaft of an auger such that the adaptor rotates with the shaft of the auger, and further wherein the auger mounting channel extends in a direction parallel to and offset from a center axis of a disk formed by the disk portion; and an ice agitator comprising a hook and an arm that extends from the hook away from the center axis of the disk, wherein the hook is mounted to the disk.

2. The ice agitation system of claim 1, wherein the auger mounting channel is a trough formed in a circumferential edge of the disk such that the disk portion forms a c-shape when the adaptor is viewed along a longitudinal axis of the auger mounting channel.

3. The ice agitation system of claim 1, wherein the hook forms a closed loop that encircles a portion of the disk portion.

4. The ice agitation system of claim 1, wherein a groove is formed in a periphery of the disk portion and the hook is configured to fit in the groove, and further wherein the disk portion comprises the disk, a second disk, and a third disk, wherein a first radius of the disk is less than a second radius of the second disk, the first radius of the disk is less than a third radius of the third disk, and the groove is formed when the disk is mounted between the second disk and the third disk.

5. The ice agitation system of claim 1, wherein the arm forms a loop.

6. An ice dispenser comprising:

an ice receptacle comprising a plurality of walls and an ice dispensing aperture formed through a wall of the plurality of walls;

an auger comprising a spherical flight and a shaft extending from the spherical flight in a direction of an axis of rotation of the spherical flight, wherein the auger is mounted between two walls of the plurality of walls and is configured to push ice toward the ice dispensing aperture based on the rotation of the spherical flight;

an actuator mounted to rotate the auger about the axis of rotation;

an adaptor comprising a disk portion and an auger mounting channel, wherein the shaft of the auger is mounted within the auger mounting channel such that the adaptor rotates with the shaft of the auger, wherein a center axis of a disk formed by the disk portion extends in a direction parallel to and offset from a center of the shaft of the auger; and an ice agitator comprising a hook and an arm that extends from the hook away from the shaft of the auger, wherein the hook is mounted to the disk.

7. The ice dispenser of claim 6, wherein the arm is curved upward from the hook when the hook is mounted to the disk.

8. The ice dispenser of claim 6, wherein the arm extends from below the hook when the hook is mounted to the disk.

9. The ice dispenser of claim 6, wherein the ice agitator further comprises a plurality of fingers that extend from the arm.

10. The ice dispenser of claim 9, wherein the plurality of fingers are distributed along the arm to extend up from the arm at different radial distances from the shaft of the auger.

11. The ice dispenser of claim 9, wherein the plurality of fingers are distributed along the arm to extend up from the arm at the same radial distance from the shaft of the auger.

12. The ice dispenser of claim 6, wherein the auger further comprises a transition section that extends between the shaft and the spherical flight and the adaptor further comprises a second auger mounting channel wherein the transition section of the auger is mounted within the second auger mounting channel.

13. The ice dispenser of claim 6, wherein the center axis of the disk formed by the disk portion is positioned to rotate about the shaft of the auger when the auger rotates.

14. The ice dispenser of claim 6, wherein the hook is mounted to the disk such that the ice agitator translates in a translation direction perpendicular to the shaft of the auger when the adaptor rotates with the shaft of the auger.

15. The ice dispenser of claim 6, wherein a groove is formed in a periphery of the disk portion and the hook is configured to fit in the groove.

16. The ice dispenser of claim 15, wherein the disk portion comprises the disk, a second disk, and a third disk, wherein a first radius of the disk is less than a second radius of the second disk, the first radius of the disk is less than a third radius of the third disk, and the groove is formed when the disk is mounted between the second disk and the third disk.

17. The ice dispenser of claim 6, further comprising a wheel mounted to the shaft of the auger to rotate with the shaft, wherein the adaptor is positioned between the wheel and the spherical flight, and the wheel includes a plurality of curved vanes configured to push the ice through the ice dispensing aperture.

18. The ice dispenser of claim 8, wherein the auger mounting channel is an orifice that extends through the disk.

19. The ice dispenser of claim 6, wherein the auger further comprises a transition section that extends at a first angle from the shaft and extends between the shaft and the spherical flight; and the adaptor further comprises a second mounting channel configured to extend from the auger mounting channel at a second angle, wherein the second angle is approximately equal to the first angle such that the transition section of the auger is mounted within the second mounting channel.

20. A device comprising:

a body defining a freezer space;

a door;

a hinge pivotally mounting the door to the body;

an ice receptacle comprising a plurality of walls and an ice dispensing aperture formed through a wall of the plurality of walls;

an ice maker mounted within the body and configured to discharge ice into the ice receptacle, an auger comprising a spherical flight and a shaft extending from the spherical flight in a direction of an axis of rotation of the spherical flight, wherein the auger is mounted between two walls of the plurality of walls and configured to push ice toward the ice dispensing aperture based on the rotation of the spherical flight;

an actuator mounted to rotate the auger about the axis of rotation;

an adaptor comprising a disk portion and an auger mounting channel, wherein the shaft of the auger is mounted within the auger mounting channel such that the adaptor rotates with the shaft of the auger, wherein a center axis of a disk formed by the disk portion extends in a direction parallel to and offset from a center of the shaft of the auger; and an ice agitator comprising a hook and an arm that extends from the hook away from the shaft of the auger, wherein the hook is mounted to the disk.

* * * * *